US011653754B2

(12) United States Patent
Carson et al.

(10) Patent No.: US 11,653,754 B2
(45) Date of Patent: May 23, 2023

(54) ADJUSTABLE HEIGHT DESK WITH ACOUSTICAL DOME

(71) Applicant: Xybix Systems, Inc., Littleton, CO (US)

(72) Inventors: David R. Carson, Larkspur, CO (US); Barry R. Carson, Highlands Ranch, CO (US); Steve Holan, Highlands Ranch, CO (US)

(73) Assignee: Xybix Systems, Inc., Englewood, CO (US)

( * ) Notice: Subject to any disclaimer, the term of this patent is extended or adjusted under 35 U.S.C. 154(b) by 0 days.

(21) Appl. No.: 17/530,648

(22) Filed: Nov. 19, 2021

(65) Prior Publication Data

US 2022/0095789 A1 Mar. 31, 2022

Related U.S. Application Data

(63) Continuation of application No. 17/122,870, filed on Dec. 15, 2020, now Pat. No. 11,191,354, which is a (Continued)

(51) Int. Cl.

*A47B 21/06* (2006.01)
*E04B 1/82* (2006.01)

(Continued)

(52) U.S. Cl.

CPC ..... *A47B 21/06* (2013.01); *A47B 9/20* (2013.01); *E04B 1/8218* (2013.01);

(Continued)

(58) Field of Classification Search

CPC ..... A47B 21/06; A47B 21/02; A47B 9/20; A47B 9/00; A47B 2024/066;

(Continued)

(56) References Cited

U.S. PATENT DOCUMENTS 3,229,846 A * 1/1966 Katz ..... B65F 1/16 220/252
3,694,974 A 10/1972 Eckel (Continued)

FOREIGN PATENT DOCUMENTS

| | | | |
|---|---|---|---|
| AT | 503021 | | 7/2007 |
| EP | 3150086 | * | 4/2017 |
| GB | 2308296 | | 6/1997 |

OTHER PUBLICATIONS

Official Action for U.S. Appl. No. 15/247,317, dated Aug. 17, 2017 13 pages.

(Continued)

*Primary Examiner* — Janet M Wilkens
(74) *Attorney, Agent, or Firm* — Sheridan Ross P.C.

(57) ABSTRACT

A novel workstation which incorporates an acoustical dome for increased acoustic and visual privacy for the user. The workstation further is adjustable in height such that it can accommodate a range of users from the $5^{th}$ percentile seated female to the $95^{th}$ percentile standing male according to the dictates of ANSI/HFES100-2007 national ergonomic standard. The workstation is further designed to be in electrical and data communication with other workstations to optimize the workstation density in an open working environment without compromising user privacy.

15 Claims, 29 Drawing Sheets

Related U.S. Application Data continuation-in-part of application No. 16/748,406, filed on Jan. 21, 2020, now Pat. No. 10,863,822, which is a continuation-in-part of application No. 16/266,299, filed on Feb. 4, 2019, now Pat. No. 10,537,173, which is a continuation of application No. 15/949,163, filed on Apr. 10, 2018, now Pat. No. 10,194,743, which is a continuation of application No. 15/247,317, filed on Aug. 25, 2016, now Pat. No. 9,949,562.

(60) Provisional application No. 62/210,845, filed on Aug. 27, 2015.

(51) Int. Cl.
*A47B 9/20* (2006.01)
*E04B 1/32* (2006.01)

(52) U.S. Cl.
CPC . *A47B 2021/066* (2013.01); *A47B 2200/0071* (2013.01); *E04B 1/3211* (2013.01); *E04B 2001/3235* (2013.01); *E04B 2001/3294* (2013.01)

(58) Field of Classification Search
CPC ..... A47B 2200/0071; F21Y 2115/10; E04B 1/8218; E04B 1/3211; E04B 2001/3234; E04B 2001/3294
USPC .... 108/50.01, 50.02, 147; 52/36.1, 36.2, 27, 52/23; 312/194–196, 223.2, 223.6
See application file for complete search history.

(56) References Cited

U.S. PATENT DOCUMENTS

| | | | | |
|---|---|---|---|---|
| 4,612,863 | A | 9/1986 | Vonhausen et al. | |
| 4,663,898 | A | 5/1987 | Yacaboni | |
| 4,784,172 | A | 11/1988 | Yacaboni | |
| 4,798,032 | A | 1/1989 | Rose, Jr. | |
| 4,874,027 | A | 10/1989 | Boundy et al. | |
| 5,177,912 | A | 1/1993 | Ball | |
| 5,428,928 | A | 7/1995 | Hellwig et al. | |
| 5,743,193 | A | 4/1998 | Kakuta et al. | |
| 5,833,332 | A | 11/1998 | Marshall et al. | |
| 5,906,420 | A | 5/1999 | Rozier, Jr. et al. | |
| 6,076,785 | A | 6/2000 | Oddsen, Jr. | |
| 6,202,361 | B1 | 3/2001 | Thorp et al. | |
| 6,202,567 | B1 | 3/2001 | Funk et al. | |
| 6,248,014 | B1 | 6/2001 | Collier | |
| 6,848,369 | B1 * | 2/2005 | King | A47B 21/06 108/50.01 |
| 7,143,709 | B2 | 12/2006 | Brennan et al. | |
| 7,377,078 | B2 | 5/2008 | Golino et al. | |
| 7,789,025 | B2 | 9/2010 | Michaud, II et al. | |
| 7,871,280 | B2 | 1/2011 | Henriott | |
| 8,225,723 | B2 | 7/2012 | Nakamura et al. | |
| 8,596,599 | B1 | 12/2013 | Carson et al. | |
| 8,845,016 | B2 | 9/2014 | Domash | |
| 9,003,979 | B2 | 4/2015 | Bahnof | |
| D740,784 | S | 10/2015 | O'Polka | |
| 9,624,718 | B2 | 4/2017 | Geller et al. | |
| 9,949,562 | B2 | 4/2018 | Carson et al. | |
| 10,194,743 | B2 | 2/2019 | Carson et al. | |
| 10,537,173 | B2 | 1/2020 | Carson et al. | |
| 10,863,822 | B2 | 12/2020 | Carson et al. | |
| 11,191,354 | B2 | 12/2021 | Carson et al. | |
| 2003/0067256 | A1 | 4/2003 | Stenftenagel et al. | |
| 2005/0016080 | A1 | 1/2005 | Williams et al. | |
| 2007/0114892 | A1 | 5/2007 | Boxenbaum et al. | |
| 2007/0271856 | A1 | 11/2007 | Ludwig et al. | |
| 2009/0133609 | A1 | 5/2009 | Nethken et al. | |
| 2010/0198374 | A1 | 8/2010 | Carson et al. | |
| 2012/0165633 | A1 | 6/2012 | Khair | |
| 2014/0106610 | A1 | 4/2014 | Byrne et al. | |
| 2014/0116632 | A1 | 5/2014 | Domash | |
| 2014/0238277 | A1 | 8/2014 | Fishman et al. | |
| 2014/0261100 | A1 | 9/2014 | Henriott et al. | |
| 2015/0016651 | A1 | 1/2015 | Domash | |
| 2015/0230761 | A1 | 8/2015 | Brumback et al. | |
| 2017/0164731 | A1 * | 6/2017 | Kemnitzer | A47B 87/002 |

OTHER PUBLICATIONS

Notice of Allowance for U.S. Appl. No. 15/247,317, dated Dec. 15, 2017 5 pages.
Official Action for U.S. Appl. No. 15/949,163, dated May 18, 2018, 11 pages.
Notice of Allowance for U.S. Appl. No. 15/949,163, dated Sep. 24, 2018, 7 pages.
Official Action for U.S. Appl. No. 16/266,299, dated Apr. 18, 2019, 13 pages.
Notice of Allowance for U.S. Appl. No. 16/266,299, dated Sep. 18, 2019 7 pages.
Official Action for U.S. Appl. No. 16/748,406, dated Mar. 18, 2020 18 pages.
Notice of Allowance for U.S. Appl. No. 16/748,406, dated Aug. 18, 2020 9 pages.
Notice of Allowance for U.S. Appl. No. 17/122,870, dated Jul. 26, 2021 8 pages.

* cited by examiner

FIG. 25
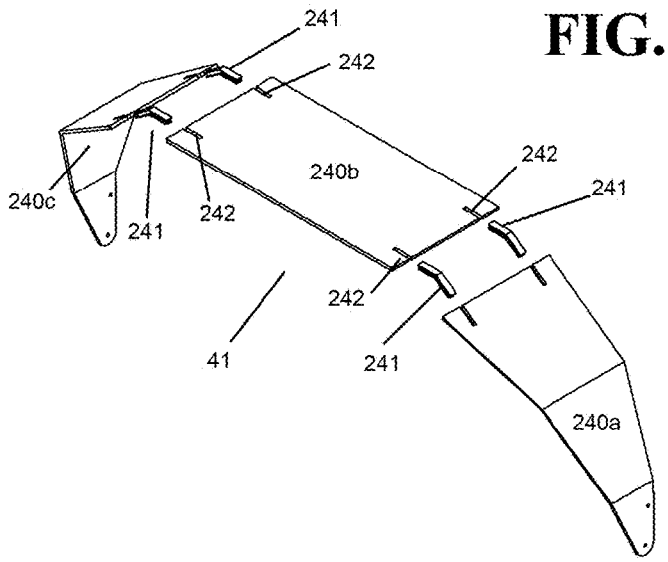
FIG. 24a
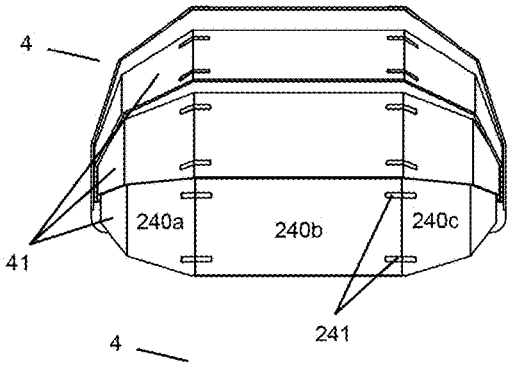
FIG. 24b
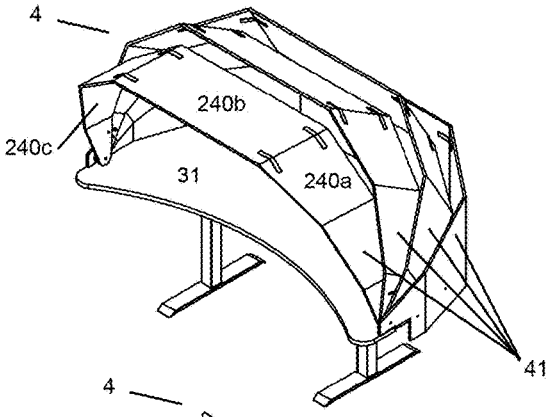
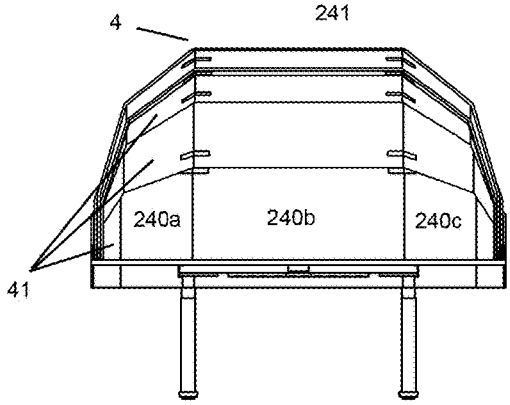
FIG. 24c
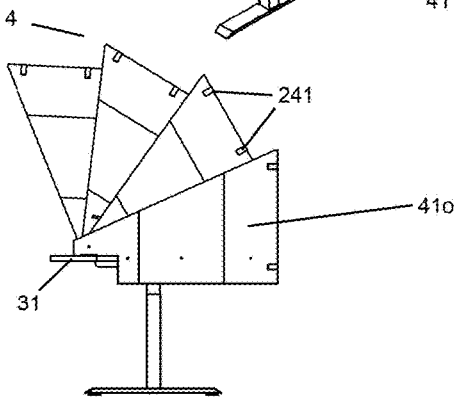
FIG. 24d

ADJUSTABLE HEIGHT DESK WITH ACOUSTICAL DOME

CROSS-REFERENCE TO RELATED APPLICATIONS

This application is a continuation of U.S. patent application Ser. No. 17/122,870, filed Dec. 15, 2020 (now issued U.S. Pat. No. 11,191,354, issued Dec. 7, 2021), which is a continuation-in-part of U.S. patent application Ser. No. 16/748,406, filed Jan. 21, 2020 (now U.S. Pat. No. 10,863,822, issued Dec. 15, 2020), which is a continuation of U.S. patent application Ser. No. 16/266,299, filed Feb. 4, 2019 (now U.S. Pat. No. 10,537,173, issued Jan. 21, 2020), which is a continuation of U.S. patent application Ser. No. 15/949,163, filed Apr. 10, 2018, (now U.S. Pat. No. 10,194,743, issued Feb. 5, 2019), which is a continuation U.S. patent application Ser. No. 15/247,317, filed Aug. 25, 2016 (now U.S. Pat. No. 9,949,562, issuing Apr. 24, 2018), which claims priority from U.S. Provisional Patent Application Ser. No. 62/210,845 filed on Aug. 27, 2015, the entireties of all of which are incorporated herein by reference.

FIELD OF THE INVENTION

The present invention relates to an acoustical workspace module for improving privacy and employee production.

BACKGROUND OF THE INVENTION

In the United States and abroad, many companies employ an open office design. In addition to optimizing office space, this design was intended to foster teamwork between employees. However, this design has led to the rise of a layout which is derisively known as a "cubicle farm." Cubicle farms are often seen as a symbol for the monotony of corporate life and are often used in movies and television as a plot device for a main character wherein they must escape their mundane life, epitomized by their job at a corporate cubicle farm.

Perhaps more importantly to a company, cubicle farms lower productivity in the workplace and have a negative impact on employees, affecting everything from personal privacy to health. Studies have shown, for example, that conversations between employees in a cubicle farm can lead to a 5 to 10 percent decline in performance by employees not involved in the conversations. Similarly, global studies show that, on average, people sit an average of 7.7 hours per day, with some people sitting as much as 15 hours a day. As a result of all this sitting, scientists have coined the term "sitting disease" which can cause obesity, high blood pressure, diabetes, cancer, depression, and various other maladies. While many attempts have been made to remedy these problems, the modern office environment has remained relatively unchanged.

One such change to the modern office environment is the move from cubicles to "desking." Desking is the concept of replacing cubicles and cubicle walls with freestanding desks, often with desk mounted screens of various materials which provide a limited "fence" around an individual's workspace. However, while desking may do away with the perception of a "cubicle farm," it fails to address the present privacy and health concerns present in the modern office environment. Furthermore, desking does not prevent the so-called "prairie dog effect," in which some employees are standing while others are sitting, further reducing privacy among employees.

To remedy the health problems with excessive sitting, one obvious solution has been to increase standing during the workday. Studies have shown that even just taking breaks during periods of prolonged sitting may lower the health risks of sitting. Several patents have been pursued which attempt to utilize the health benefit of intermittent standing.

U.S. Pat. No. 9,003,979 shows one example of a stand-alone standing desk and is hereby incorporated by reference in its entirety. The '979 patent provides a desk which may be utilized in the standing position to reduce some of the common side effects with prolonged sitting. However, the desk of the '979 patent only allows for working in a standing position, which may not be practical for all employees, as it could lead to joint compression, muscle fatigue, and various other health problems. Additionally, the use of a standing desk in a typical open office environment may not be optimal as it would require the purchase of new desks for employees and lead to the above-mentioned "prairie dog effect." Furthermore, the above standing desk fails to create a workstation which is ergonomically appropriate for more than a single individual. Standing for a $5^{th}$ percentile female user differs completely from standing for a $95^{th}$ percentile male. Accordingly, the above standing desk fails to provide an ergonomic solution for the modern office environment.

Another attempt to address the stand-sit balance are adjustable support structures which do not require the purchase of an entirely new desk for an employee, as exemplified by U.S. Pat. No. 6,076,785, hereby incorporated by reference in its entirety. The '785 patent provides an adjustable support structure which may be mounted on an existing desk and allows employees to sit and stand at their discretion. However, these desks still do not address the "prairie dog effect" problem, and further, these support arm structures are often only able to carry a certain amount of weight. Thus, if an employee is utilizing dual monitors or various other features, the arm may not be able to remain in the standing position. Furthermore, typical non-adjustable desks such as the above stand at approximately 28"-29" which is the seated height for a male in the $95^{th}$ percentile. Accordingly, anyone smaller than a male in the $95^{th}$ percentile will find it impossible to achieve a proper seated position according to ANSI/HFES100-2007.

Similarly, there have been many attempts to remedy the privacy concerns of the open office design. U.S. Pat. No. 7,377,078 is representative of this effort and is hereby incorporated by reference in its entirety. The '078 patent discloses an integrated and adjustable privacy enclosure for workspace environments. However, the invention disclosed does not differ greatly in terms of privacy considerations from the typical cubicle walls commonly employed. Additionally, utilizing the privacy wall structures in conjunction with standing or sit-stand desks completely negates the added privacy as employees would be able to see over the privacy barriers.

Other attempts to remedy privacy concerns involve the use of partial visual shields, as exemplified in U.S. Pat. No. 8,845,016. The '016 patent relates to mountable visual and/or acoustic privacy features which at least dampen the audio and visual pollution a user receives. However, the device presented in the '016 uses shades or panels that can only be used to block out audio/visual from the sides or audio/visual from the front. However, when used on the sides, a user is completely exposed from the front and back. Similarly, when used in front of the user, they are susceptible to noise and visual pollution from both sides and the back.

To provide complete privacy, completely self-contained modules have been suggested, a representative example of which is described in U.S. Pat. No. 6,248,014, which is hereby incorporated by reference in entirety. The '014 patent describes a self-contained activity module, which includes a work desk and chair enclosed in a housing, but open on both sides. However, while this design incorporates several features to improve the comfort of the user, it is still susceptible to audio and visual pollution from the sides. Perhaps more importantly, this design is not practical in an open office environment. The bulky nature of the design would make for an inefficient use of office space, and the cost per employee would be high.

Thus, there is a need for a desk which provides privacy to the user in both a sitting and standing position as well as to the other employees in the office, and which is designed to be used in an open office environment without compromising the efficient use of office space. Other problems in the field which need addressing include cabling concerns; lack of personalized lighting, air flow, and temperature controls; no individual customization; environmental considerations including improving employee attitude, creating fun and exciting work environments, and reducing stress.

SUMMARY OF THE INVENTION

Consistent with the above-mentioned needs, the present invention provides an adjustable height workstation having a selectively removable/collapsible acoustical dome for providing privacy to both the user and the surrounding users. Additionally, the present invention aims to provide a complete health and fitness environment for the user to improve work productivity and reduce work-related illnesses.

It is an object of the present invention to provide a desk in which the height can be adjusted. To accomplish this, the desk is designed such that it meets or exceeds the five elements proscribed in the current National Ergonomic Standard ANSI/HFES100-2007 for the $5^{th}$ percentile seated female to the $95^{th}$ percentile standing male user. These elements include keyboard height, wrist angle, monitor view angles, primary reach zone, foot and leg clearances, and focal depth requirements. In a preferred embodiment, the height adjustment is accomplished using telescopic legs, which may either be adjusted manually or by automated means known in the art. While the use of telescopic legs is envisioned, one skilled in the art will recognize that any adjustable height means may be utilized with the present invention.

It is another object of the present invention to provide a means for managing a plurality of accessories and cords. To accomplish this, there is provided a cable management raceway. In a preferred embodiment, this raceway may house a modular third party vendor's multiple circuit electrical distribution system as well as additional optional components such as ventilation fans, speakers, USB charging ports, rheostats for dimming integral LED lights, adjusting fan speed, motor control for the adjustable height table, along with any additional accessories deemed necessary by the user. The raceway serves to eliminate the common problem of a "rat's nest" of cabling found in most computer intensive workplace environments through an easy to access "cable dump" channel. The "cable dump" channel further employs a "no tools" cap which can simply be lifted off the top of the raceway for access to plug in a component or to simply hide or conceal excess cabling.

It is yet another object of the present invention to provide increased acoustical and visual privacy to a user. This is accomplished using a selectively removable acoustical dome or privacy shield. In a preferred embodiment, the dome is a geodesic dome based on the concept first introduced by R. Buckminster Fuller (although one of skill in the art will appreciate a vast variety of shapes for such enclosure, including but not limited to polygonal tiles, ovals, or curved pieces). The dome can be made in a variety of sizes and out of a variety of materials based on the needs of the user. In this regard, U.S. Patent Publication No. 2015/0016651 to Domash is incorporated herein by this reference, demonstrating the variety of visual/acoustic privacy features that may be desired. The dome acts to block the view from individual workstations and eliminates the potential for a "prairie dog effect" when some users are seated and others are standing. In addition, the interior surface of the dome may be modified to provide unique interfaces to the users or to incorporate features for the benefit of an employer.

In one embodiment, the acoustical dome is comprised of a plurality of triangular pieces which are selectively interconnected to one another to create the acoustical dome. In addition, the triangular pieces are interchangeable, which allows for user customization, in terms of transparency, color, or acoustical and light transmittance characteristics. The triangular pieces can be a variety of sizes depending on the needs of the user. In another embodiment, the pieces are pentagonal, hexagonal, heptagonal, or any other geometric shape. Additionally, the acoustical dome may be created by a combination of two or more geometric pieces.

In one embodiment, the geometric pieces are made of fiberglass. However, one skilled in the art will recognize that the pieces may be made of plastic, glass, metal, wood, polymers, carbon fiber, or other building materials. Additionally, the pieces can be composed of multiple materials. In other embodiments, the dome may be pre-constructed and sized to fit in a groove on the desk surface. For example, there may be an outer metal rim surrounding glass, creating a modern aesthetic similar to that present in the Louvre glass pyramid. Furthermore, the pieces can be made from a variety of electrically conductive materials or computerized screens which may provide digital environments to the user or may allow a user to "frost" the glass of their acoustical dome for added privacy. Other materials which may also be employed as geometric pieces in the acoustical dome, selected for one or more of the characteristics set forth below: weight, color, transparency, sound absorption qualities, digitization, or structural properties.

Once the dome is assembled, the outer appearance can vary greatly depending on the desire of the user or employer. For example, the dome may be transparent or opaque based on the materials used. However, a user may further customize the outer appearance of the dome. For example, the dome may be painted or have a print on it. For example, the outer surface of the dome may provide a tree pattern, which, in conjunction with other acoustical domes may give the impression of a desired visual depiction, e.g. a coast, a beach, a forest, a jungle, etc. In addition, the outer surface of the dome may be a variety of colors, patterns, moving patterns, light arrays, or may even change colors or themes in a rotation.

Similarly, the interior surface of the acoustical dome can also vary greatly. For example, depending on the materials used, the interior surface may be suitable for a digital projection of a beach or other relaxing environment to boost user productivity. It may thus be varied to the desires of a user to customize a personal working environment to avoid claustrophobia issues, to vary a worker's attitude or alertness, to conform to other environmental modifications, such as sounds (e.g. waves or a beach to coincide with the interior depiction of a sea shore; wind sounds to coincide with fanned air; a moving visual depiction such as a looped reel of a ½ hour video of a deserted beach with moving waves, trees, etc.) The interior surface can also be any number of colors, patterns, moving patterns, light arrays, or any combination of these. The interior surface is envisioned to be completely customizable for the user or employer.

While the above describes the shell as an acoustical dome, one skilled in the art will recognize that the shell may be a variety of geometric shapes including a cube, a pyramid, an ellipse, or a custom shape selected by the employer and unique to that work environment.

It is another object of the present invention to provide a spacious user workspace. In a preferred embodiment, this is accomplished through a 60" diameter work surface which incorporates a user cutout designed to move the user into the acoustical dome for maximum acoustical effect while maintaining efficient workstation density. In one embodiment of the present invention, the workspace is provided with anti-microbial laminates for killing or resisting the presence of germs on the work surface. This anti-microbial laminate, in conjunction with a UV-C air purifier, works to reduce a high percentage of both surface and airborne germs, lessening the spread of sickness at work, reducing the number of sick days, and therefore increasing productivity and health in the workplace. Various standard anti-microbial laminate may be employed, for example, one such anti-microbial laminate includes Sharklet™ technology, described in U.S. Pat. No. 7,143,709 and hereby incorporated by reference in its entirety, may be employed to improve the anti-microbial properties of the workstation.

It is another object of the present invention to allow for novel and unique workstation layout designs in an open office space. This is accomplished in part using the above-mentioned cabling/electronic connector raceway. In a preferred embodiment, the raceway further includes access holes routed through the work surface, at the bottom of the raceway and concealed from view, preferably located at a specified angle of 30° to enable the creation of multiple layouts. The raceway holes located at 30° intervals also provide an entry point for the various cables emanating from the back of the CPU which is hung under the "wing" of the table on either the right or left side of the user. These cables could be USB to control both the keyboard and the mouse, the power cord for the CPU itself, headset or speaker jacks, network cables, and monitor cables. This provides an extremely neat and organized cable array on the back of the CPU—excess cable is stored in the above surface raceway hidden from view, yet easily accessible for service. Additionally, this design also allows for achieving a maximum density of users without compromising ergonomics, acoustical performance, or other features provided for in the design. The raceway can further include a fully integrated commercially available multiple circuit electrical distribution system which further prevents the creation of a "rats' nest" from excess cords and cabling. In yet another embodiment, the raceway can further include a built-in air purifier, USB ports, electrical outlets, lights, speakers, webcams, or a variety of features deemed beneficial by the user or employer.

In one embodiment, the workstations are isolated from one another, further improving the acoustical and visual privacy. In another embodiment, the workstations are placed in "clusters" wherein two or more workstations are interconnected. In preferred embodiments, the workstations are all selectively connectable via the raceway, which allows for cords to travel from one workstation to another in a predetermined configuration designed to maximize the efficient use of space, cords, etc. In one embodiment, the workstations are connected in a zig-zag fashion incorporating as many workstations as is necessary to fill the workspace. In another embodiment, the workstations are clustered in groups of four, and placed in an efficient packing design throughout the open workspace. In yet another embodiment, the workstations are clustered in varying sizes and oriented in various directions to create an aesthetically pleasing workspace. In another embodiment, the workstations are clustered in an offset layout which helps to reduce visual distractions and enables users to be more productive. In yet another embodiment, the workstations can be placed in a geometric layout. For example, the workstations may be placed in concentric circles, further improving the aesthetics of the office.

In addition, the aesthetics of the workspace are further improved by the varying heights of the desks in combination with the acoustical domes. The presence of some desks in a standing position while others are in a seated position creates a unique "treetop" effect wherein the acoustical domes are all at different heights, giving the impression of looking out at trees of different heights. The "treetop" effect can be even more effective when the acoustical dome exterior is chosen with a jungle or forest pattern. In combination with the varying heights of the desks, the office may take on an urban jungle feel. Another example is a "skyscraper" effect in which the shell is a cube shape with an exterior pattern resembling a variety of buildings. When placed in an open work environment at different heights, this may create a cityscape or skyline effect.

It is yet another object of the present invention to allow the desk to be compatible with the "I-Fit" software control concept, described in U.S. Patent Publication No. 2010/0198374, herein incorporated by reference in its entirety. The I-Fit software allows for automated user ergonomic adjustments and individual usage history. In a preferred embodiment, users are enabled to set timers to remind them to change their working position regularly to avoid the negative effects of sitting or standing all day while working. In another embodiment, the I-Fit software can be integrated with a treadmill desk, a bicycle desk, or other exercise equipment to maintain or achieve fitness levels while working.

Additionally, the I-Fit software can track one or more fitness metrics including but not limited to calories burned, distance traveled, pace, time, etc. In one embodiment, one workstation including a treadmill or bike would be included in a cluster of several workstations, allowing individuals, in conjunction with the I-Fit software, to rotate through the treadmill or bike station as it is available. The I-Fit software would keep track of each individual's history of seated versus standing work as well as treadmill data includes miles, calories burned, etc., regardless of which workstation was used. The software could also exchange data through a "Bluetooth" connection or other electronic means and automatically synchronize with "smart watches" and other personal fitness monitors to provide a complete and comprehensive record of an individual's complete physical activity both at work and in time away from work. For example, in one embodiment devices described in U.S. Patent Publication No. 2012/0165633 and U.S. Patent Publication No. 2015/0230761, herein incorporated by reference in their entirety, could be utilized as a component of the fitness goals of the workstation.

The primary benefit and concept of the I-Fit software is to enable a proactive ergonomics program in which each user can occupy any workstation on the network and through the use of an RFID card, a fingerprint identifier, or the simple act of logging in to the network that individual is identified and their optimal working postures in either sitting or standing is automatically achieved by simply clicking and holding on an on-screen icon until the predetermined adjustment is reached. Additionally, the user's history is maintained, and management can "coach" individuals into a more healthful working routine. Additionally, a health coach could be hired to counsel and train users on the benefits associated with postural rotation (sitting and standing intervals), use of the treadmill/bike, and review each individual's fitness quotient.

It is another object of the present invention to provide a workstation, comprising an adjustable height desk having a work surface, said desk configured to conceal from view at least two accessories selected from the group consisting of transformers, LED lights, fans, and air purifiers; and an acoustical dome comprised of segments configured to substantially cover at least half of said work surface, wherein said desk is in electrical communication with a plurality of other workstations, wherein said plurality of workstations are interconnected by cables that protrude through an underside of said work surface at predetermined intervals.

In embodiments, the workstation may further comprise a modesty shield interconnected to said desk.

In embodiments, an angle of the workstation surface of said workstation may be adjustable.

In embodiments, the at least two accessories may comprise a LED light and a fan.

In embodiments, the dome may be insulated on an interior side of the dome with sound absorbing material.

In embodiments, the dome may be selectively removable from the work surface.

In embodiments, said workstation may have a temperature control.

It is another object of the present invention to provide a workstation, comprising an adjustable height desk having a work surface, an acoustical dome comprised of segments insulated on an interior side of the dome with sound absorbing material, said acoustical dome connected to the work surface and configured to substantially cover at least half of said work surface; and a LED light connected to one of the dome and the work surface.

In embodiments, the workstation may further comprise a modesty shield interconnected to said desk.

In embodiments, said desk may further comprise a track.

In embodiments, said desk may be in electrical communication with a plurality of other workstations, and said plurality of workstations may be interconnected by cables.

In embodiments, an angle of the workstation surface of said workstation may be adjustable.

In embodiments, the dome may be selectively removable from the work surface.

In embodiments, said workstation may have a temperature control.

In embodiments, said acoustical dome may interconnect with said desk by being inserted into said track.

It is another object of the present invention to provide a workstation, comprising an adjustable height desk; an acoustical dome privacy shield, wherein said privacy shield selectively interconnects with said desk and wherein said privacy shield provides acoustic and visual privacy to the user; wherein said desk further includes a plurality of built-in accessories and is adapted to accommodate a multiple circuit electrical distribution system to permit the use of power strips, wherein said desk is further adapted to conceal various accessories, said accessories including at least one of transformers, LED lights, fans, and air purifiers, and wherein said acoustical dome privacy shield comprises a plurality of pieces, each piece comprising a plurality of sections, each section comprising at least one rectangular or trapezoidal element, wherein the sections of each piece are adapted to be securely affixed to one another by a connector.

In embodiments, the workstation may further comprise a modesty shield interconnected to said desk.

In embodiments, the acoustical dome privacy shield may cover more than half of said work surface.

In embodiments, said desk may be adapted to allow the workstation to be in at least one of electrical and data communication with a plurality of other workstations, and said plurality of workstations may be adapted to be interconnected using flexible cables.

It is another object of the present invention to provide a workstation, comprising an adjustable height desk having a work surface, said desk configured to conceal from view at least two accessories selected from the group consisting of transformers, LED lights, fans, and air purifiers; an acoustical privacy shield configured to substantially cover at least half of said work surface, said privacy shield selectively interconnecting with said desk; wherein said desk is in electrical communication with a plurality of other workstations, wherein said plurality of workstations are interconnected by cables that protrude through an underside of said work surface at predetermined intervals, and wherein said acoustical privacy shield comprises a plurality of pieces, each piece comprising a plurality of sections, each section comprising at least one rectangular or trapezoidal element, wherein the sections of each piece are adapted to be securely affixed to one another by a connector.

In embodiments, the workstation may further comprise a modesty shield interconnected to said desk.

In embodiments, an angle of the work surface of said workstation may be adjustable.

In embodiments, the at least two accessories may comprise a LED light and a fan.

In embodiments, the dome privacy shield may be insulated on an interior side of the dome privacy shield with sound absorbing material.

In embodiments, the dome privacy shield may be selectively removable from the work surface.

In embodiments, said workstation may have a temperature control.

It is another object of the present invention to provide a workstation, comprising an adjustable height desk having a work surface, an acoustical dome privacy shield insulated on an interior side of the dome privacy shield with sound absorbing material, said acoustical dome privacy shield connected to the work surface and interconnected to said desk and configured to substantially cover at least half of said work surface; a LED light connected to one of the dome privacy shield and the work surface, wherein said acoustical dome privacy shield comprises a plurality of pieces, each piece comprising a plurality of sections, each section comprising at least one rectangular or trapezoidal element, wherein the sections of each piece are adapted to be securely affixed to one another by a connector.

In embodiments, the workstation may further comprise a modesty shield interconnected to said desk.

In embodiments, said desk may be in electrical communication with a plurality of other workstations, and said plurality of workstations may be interconnected by cables.

In embodiments, an angle of the work surface of said workstation may be adjustable.

In embodiments, the dome privacy shield may be selectively removable from the work surface.

In embodiments said workstation may have a temperature control.

Further description of advantages, benefits, and patentable aspects of the present disclosure will become evident from the accompanying drawings and description herein below. All novel aspects of the disclosure, whether mentioned explicitly in this Summary section or not, are considered subject matter for patent protection either singly or in combination with other aspects of this disclosure. Accordingly, such novel aspects disclosed herein below and/or in the drawings that may be omitted from, or less than fully described in, this Summary section are fully incorporated herein by reference into this Summary. Particularly, all (any) claims of the Claims section herein below are fully incorporated herein by reference into this Summary section.

BRIEF DESCRIPTION OF THE DRAWINGS

FIG. 7 shows a plurality of layout embodiment diagrams for the workstation embodiment of FIG. 1;

FIGS. 24*a*, 24*b*, 24*c*, and 24*d* show top, perspective, end, and side views, respectively, of the structural elements that construct an acoustical privacy shield according to a third embodiment of the present invention; and FIG. 25 shows an exploded view of sections of a piece of an acoustical privacy shield according to the embodiment illustrated in FIGS. 24*a* through 24*d*.

DETAILED DESCRIPTION OF THE INVENTION

Figure 1:
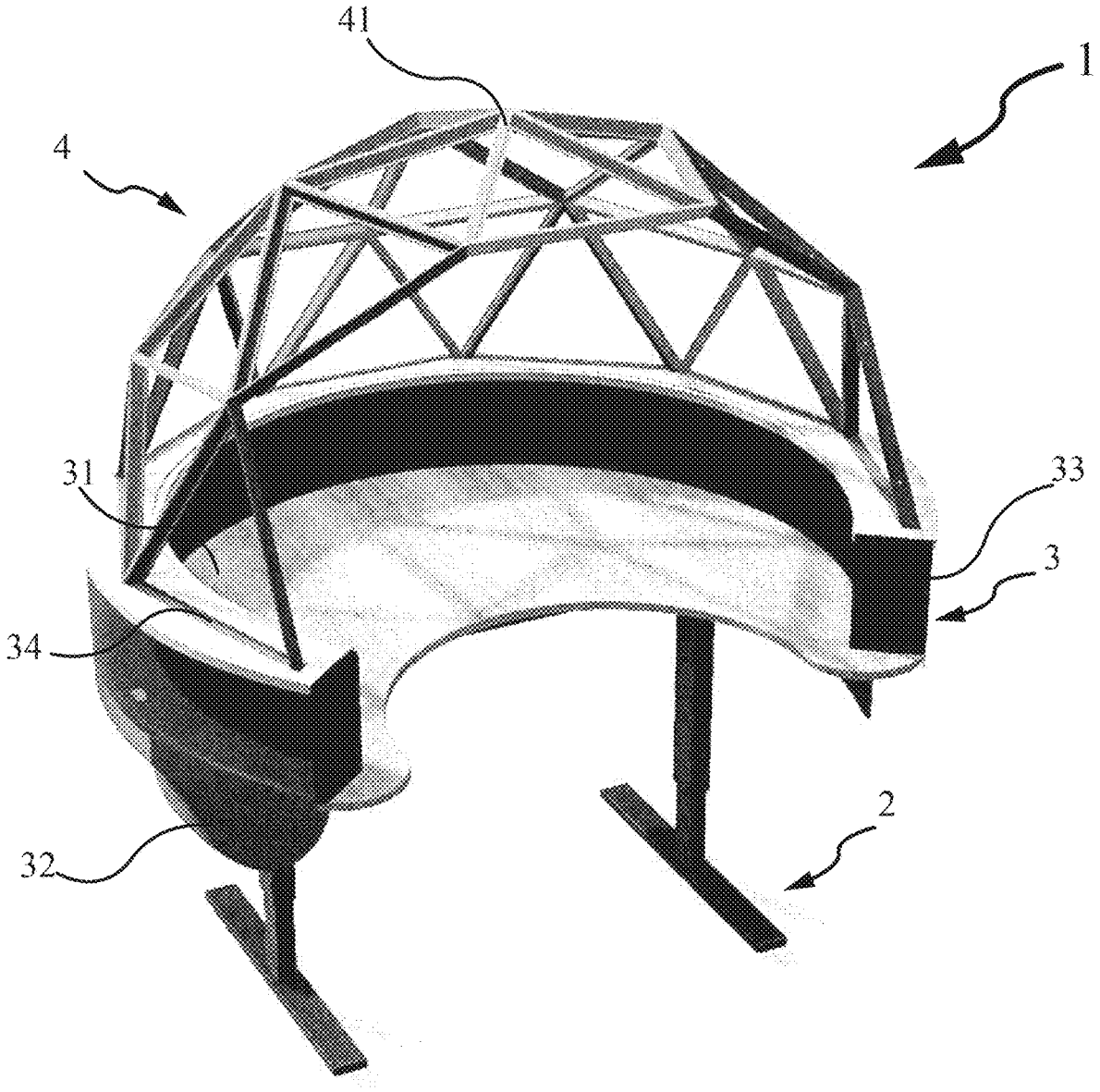
FIG. 1 is an elevated perspective view of one embodiment of the present invention.

FIG. 1 shows a perspective view of an embodiment of the acoustical dome workstation 1. Specifically, FIG. 1 shows the acoustical dome workstation 1 comprising a base 2, a body 3, and an acoustical dome 4. The base 2 is interconnected to a bottom surface of the body 3 such that the body 3 is level to provide an optimal working environment for a user. The body 3 further includes a level work surface 31, a "modesty skirt" 32, and a raceway 33. The raceway 33 further includes a track 34 which is adapted to selectively interconnect with the acoustical dome 4. The acoustical dome 4 is comprised of a plurality of geometric pieces 41 which selectively interconnect to form the acoustical dome 4. While FIG. 1 shows only the structural frame of the dome 4, one having skilled in the art will recognize that the geometric pieces 41 utilized are not necessarily limited to frame elements. Rather, the geometric pieces 41 can be solid panel-like pieces constructed from a variety of materials, discussed in greater detail in the subsequent disclosure.

Figure 2:
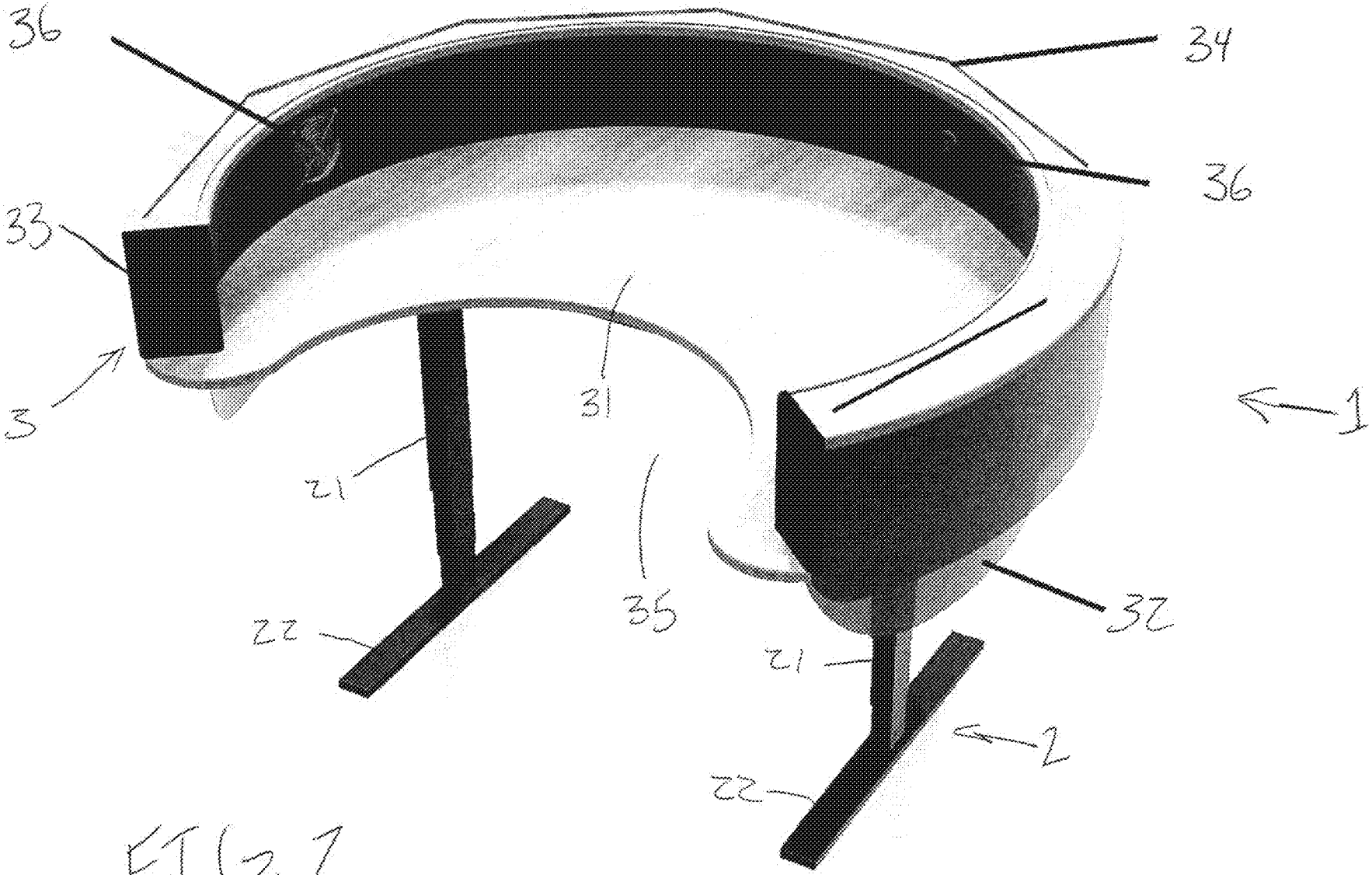
FIG. 2 is an elevated perspective view of one embodiment of the present invention without an acoustical dome.

FIG. 2 depicts the workstation 1 of FIG. 1 without the acoustical dome. As shown, the base 2 includes two telescopic legs 21 each further having a support structure 22. However, one skilled in the art would recognize that various base 2 structures may be used, including non-telescopic legs of various heights, a various number of legs, legs of various widths including legs which also serve as drawers, and wall-like legs. The base 2 and body 3 may be part of one integral workstation 1, or the base 2 and body 3 may be selectively connectable for easy transportation.

The workstation 1 may further include a modesty skirt 32 which is connected to the perimeter of the body 3 and extends around the perimeter of the body 3. One skilled in the art will appreciate that the modesty skirt 32 may be of various lengths and does not necessarily have to extend around the entire perimeter of the body 3. The modesty skirt 32 may be comprised of a plurality of materials including but not limited to various plastics, fabrics, polymers, metals, cardboard, or other materials which provide privacy for the user. The modesty skirt 32 may be transparent, opaque, or may be designed such that the transparency may be chosen by the user. The height of the modesty skirt 32 may be varied depending on the needs of the user and based on the position of the workstation 1 relative to other workstations. Additionally, the modesty skirt 32 may be selectively removable or collapsible such that a user may remove it if the modesty skirt 32 is not necessary.

The body 3 of the workstation 1 further includes a work surface 31. In a preferred embodiment, the work surface 31 is circular in shape having a 60" diameter work surface 31. However, one skilled in the art would recognize that the shape and the diameter of the work surface 31 may be adjusted based on the needs of the user. For example, smaller work surfaces 31 may be employed for children or for small working spaces, while larger work surfaces 31 may be employed for high volume workers who require a higher surface area work surface 31 or for large open working spaces. Additionally, the work surface 31 may be a variety of shapes including rectangular, triangular, elliptical, etc. The work surface 31 may be constructed of a variety of materials, including but not limited to plastic, metal, wood, polymer, and carbon fiber and may further include a laminate surface. In a preferred embodiment, this laminate surface may be an anti-microbial laminate. One such anti-microbial laminate includes Sharklet™ technology, described in U.S. Pat. No. 7,143,709 and hereby incorporated by reference in its entirety, may be employed to improve the anti-microbial properties of the workstation. However, one skilled in the art will recognize that any anti-microbial laminate may be utilized. In a preferred embodiment, the circular work surface 31 may include a user cutout 35. This cutout 35 allows the user to move into or under the acoustical dome 4 for maximum acoustical effect and maximum privacy while maintaining efficient density. In a preferred embodiment, the cutout 35 is semi-circular in shape. However, one having skill in the art will recognize that the cutout 35 may be a variety of shapes including circular, rectangular, triangular, elliptical, etc. and may optionally be of the same shape as the work surface 31.

The body 3 of the workstation 1 further includes a raceway 33 which rests on the work surface 31. In a preferred embodiment, the raceway 33 may have multiple uses. First, the raceway 33 may act as an electrical distribution system and house a concealed 8 or 10 wire multiple circuit electrical distribution system. The raceway 33 includes cutouts at 30° intervals under the raceway to accommodate electrical/data and allow for various layout capabilities simply by rotating the workstation 1. These features will be discussed in greater detail in FIGS. 6-8.

The raceway 33 may further act as a cable dump for excess cable which permits a clean and organized work surface 31 using standard length cables, eliminating the need for cable management accessories. Additionally, the raceway 33 may permit the use of regular 6 outlet power strips which may plug into the pre-engineered power distribution system and be used to power up a CPU, monitor(s), lighting including LEDs, fans, and various other accessories a user may deem necessary. The raceway 33 may further include one or more built in accessories 36. The accessories may include fans, USB chargers, standard outlets, lighting, air purification systems, and any other accessories a user deems necessary. In a preferred embodiment, the air purification system is a UVC light/fan type air purifier which can kill and minimize airborne germs. However, one skilled in the art will recognize that any air purification system may be utilized.

The raceway 33 may further include a track 34 which extends a discrete distance into the raceway 33 and is adapted to receive an acoustical dome 4. The track 34 may be of a various shapes and depths, depending on the needs of the user. In a preferred embodiment, the track 34 is adapted to receive a geodesic acoustical dome 4 as show in FIG. 1. However, one skilled in the art will recognize that the track 34 shape and depth may be altered to accommodate a different acoustical dome 4 shape and structure.

Figure 3:
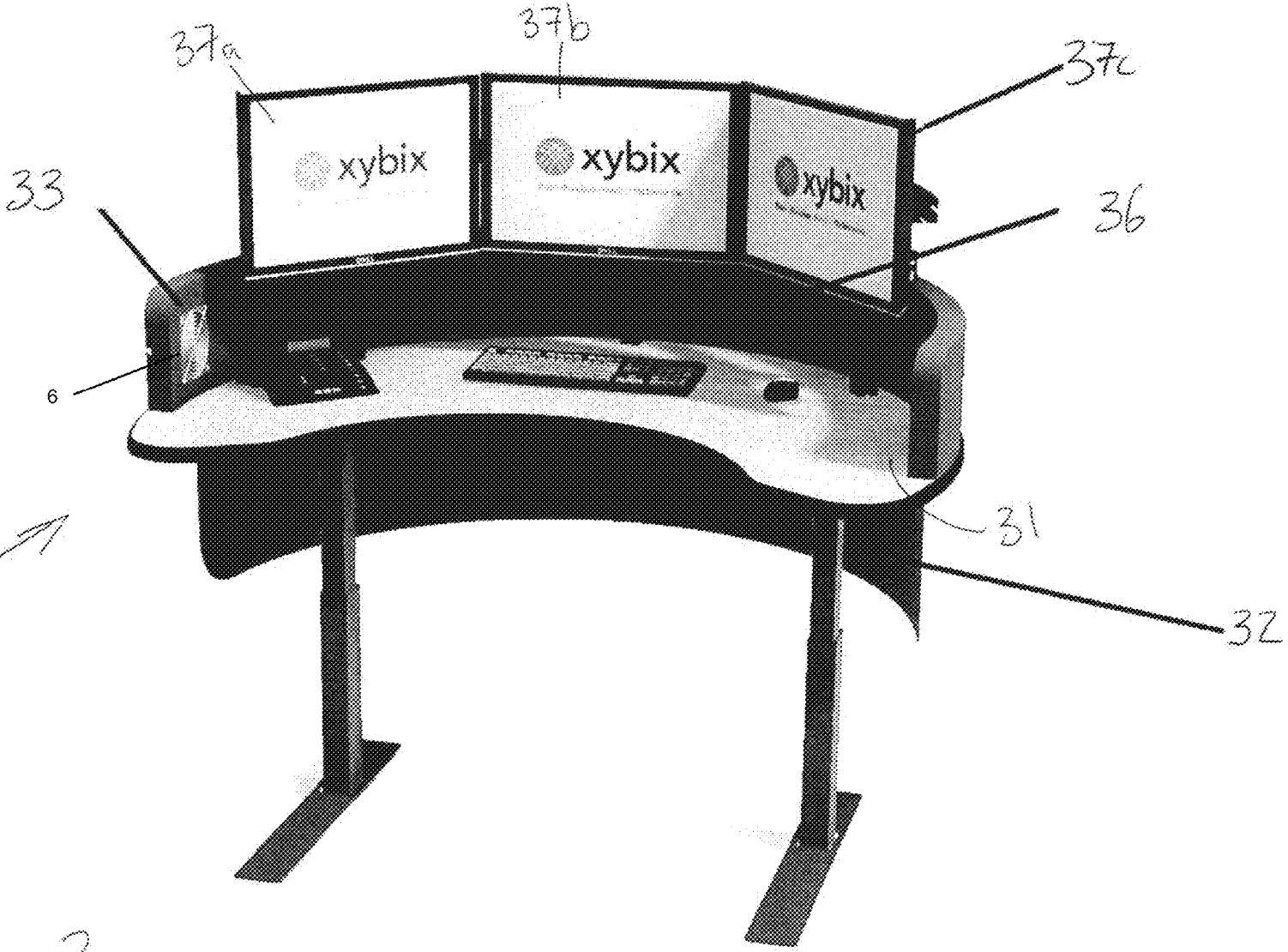
FIG. 3 is an elevated perspective view of the embodiment of FIG. 2 in use.

FIG. 3 shows how the workstation 1 of FIG. 2 could be utilized in one embodiment. In a preferred embodiment, the workstation 1 utilizes three monitors 37*a*, 37*b*, 37*c*, arranged side-by-side, which may be mounted to the work surface 31. However, one skilled in the art would recognize that the number and arrangement of monitors 37 utilized may be altered based on the needs of the user. By way of example and without intending to limit the scope of the present disclosure, a user may utilize one, two, three, or four monitors 37 in a side-by-side arrangement, and may further include a fifth, sixth, seventh, and eighth monitors 37 arranged in a side-by-side arranged but stacked on top of first four monitors. Alternatively, the user may utilize a variety of other monitor 37 arrangement including a diamond shape, triangular shape, or rectangular shape arrangement. Further, the monitors 37 may be the same size, or could also be a combination of different size monitors 37. This customization allows the user to choose the monitors 37 and arrangement which meets the needs of the work for which they are being used. Additionally, while the monitors 37 may be mounted to the work surface 31, one skilled in the art will recognize they may also be mounted to the raceway 33 or may be freestanding. In a preferred embodiment, a fixed version of device found in U.S. Pat. No. 8,596,599, herein incorporated by reference, is utilized, allowing limited horizontal and vertical adjustment while using less space than a monitor arm and other traditional means of monitor mounting. In addition, while not shown in FIG. 3, the monitors 37 may also be integrated into the acoustical dome 4. FIG. 3 further illustrates other accessories which may be utilized with the expansive work surface 31. By way of example, the accessories may include a telephone, a keyboard, a mouse, speakers, utensil holder, file tray, stapler, hole punch, or any other accessory deemed necessary by the user. Additional optional components may be included, such as ventilation fans 6, speakers, USB charging ports, rheostats for dimming integral LED lights, adjusting fan speed, motor control for the adjustable height table, along with any additional accessories deemed necessary by the user.

Figure 4:
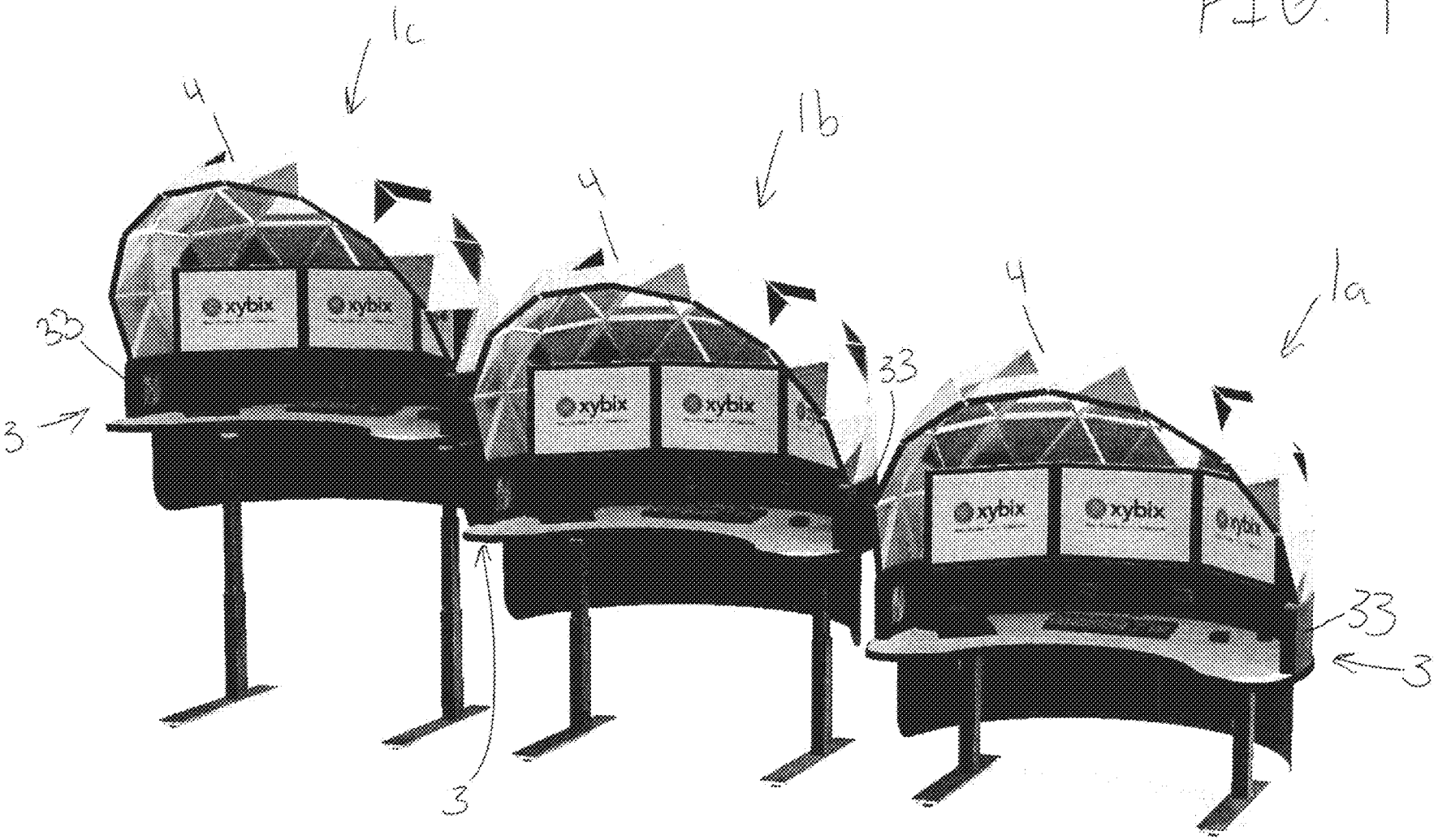
FIG. 4 shows one embodiment of the present invention at varying heights.

FIG. 4 depicts one embodiment of the workstation 1 in which the height of the workstation 1 is adjustable. FIG. 4 shows the workstation 1 in three different height positions: a minimum height 1*a*, a medium height 1*b*, and a maximum height 1*c*. However, one skilled in the art will recognize that the various heights 1*a*, 1*b*, 1*c* are only representative, and that the actual height of the workstation 1 may be any height between a minimum height 1*a* ($5^{th}$ percentile seated female) and a maximum height 1*c* ($95^{th}$ percentile standing male user). In a preferred embodiment, the workstation 1 is adapted to comply with the five requirements of ANSI/HFES100-2007 National Ergonomic Standard for computer workstations such that it enables individualized fit for all potential users from the $5^{th}$ percentile seated female user up to the $95^{th}$ percentile standing male user. The five requirements are keyboard height/elbow angle, monitor height/view angle, focal depth, primary reach zone, and user safety clearances. These ergonomic considerations allow the user to avoid the negative health consequences of sitting or standing all day, while achieving a customized ergonomic fit for their individual physical attributes.

FIG. 4 further shows one embodiment of the acoustical dome 4. As shown, the acoustical dome 4 shields the user from other users who may be located adjacent to the workstation 1. The acoustical dome 4 is constructed from selectively interconnecting geometric pieces. In the embodiment illustrated in FIG. 4, the pieces are triangular. However, one skilled in the art will recognize that the pieces may be pentagonal, hexagonal, heptagonal, or any other geometric shape. Additionally, the acoustical dome may be created by a combination of two or more geometric pieces with a different geometric shape. Similarly, while an acoustical dome is a preferred embodiment of the present invention, one having skill in the art will recognize that the acoustical privacy shield 4 may be a cube, pyramid, cone, ellipse, or other shape based on the needs of the user. As shown, the dome 4 is connected to the body 3 via the track in the raceway 33 and extends above and behind the user to improve privacy.

In another embodiment, the monitors may be integrated into the acoustical dome 4. This can be done either by utilizing electronically interconnected geometric pieces which allow the geometric pieces to act as the monitors. Alternatively, the monitors may be built into the acoustical dome 4 design and surrounded by geometric pieces.

In embodiments, the workstation 1 and/or the acoustical dome 4 may include lighting elements, and in particular may include one or more light-emitting diodes (LEDs) or strips or banks thereof, which may be affixed to any suitable portion of a work surface 31 and/or an inward-facing (work surface-facing) surface of the acoustical dome 4. It may be particularly preferable for lighting included on the work surface 31 and/or the acoustical dome 4 to be controllable by a user of the workstation 1, e.g. to allow a user to brighten, dim, and/or change the color of the LEDs or other lights. In this way, the user of an individual workstation 1 may be able to illuminate the workstation 1 to his or her individual preferences, which (in environments where a plurality of workstations 1, each having a separate user, is provided) may allow for a decrease in the amount of ambient light, e.g. to the degree needed to provide safe egress from the environment in an emergency. Thus, providing each workstation 1 with lighting controllable by the user of the workstation 1 may result in an overall reduction in electrical usage, thus providing an important advantage and benefit relative to the prior art.

Figure 5:
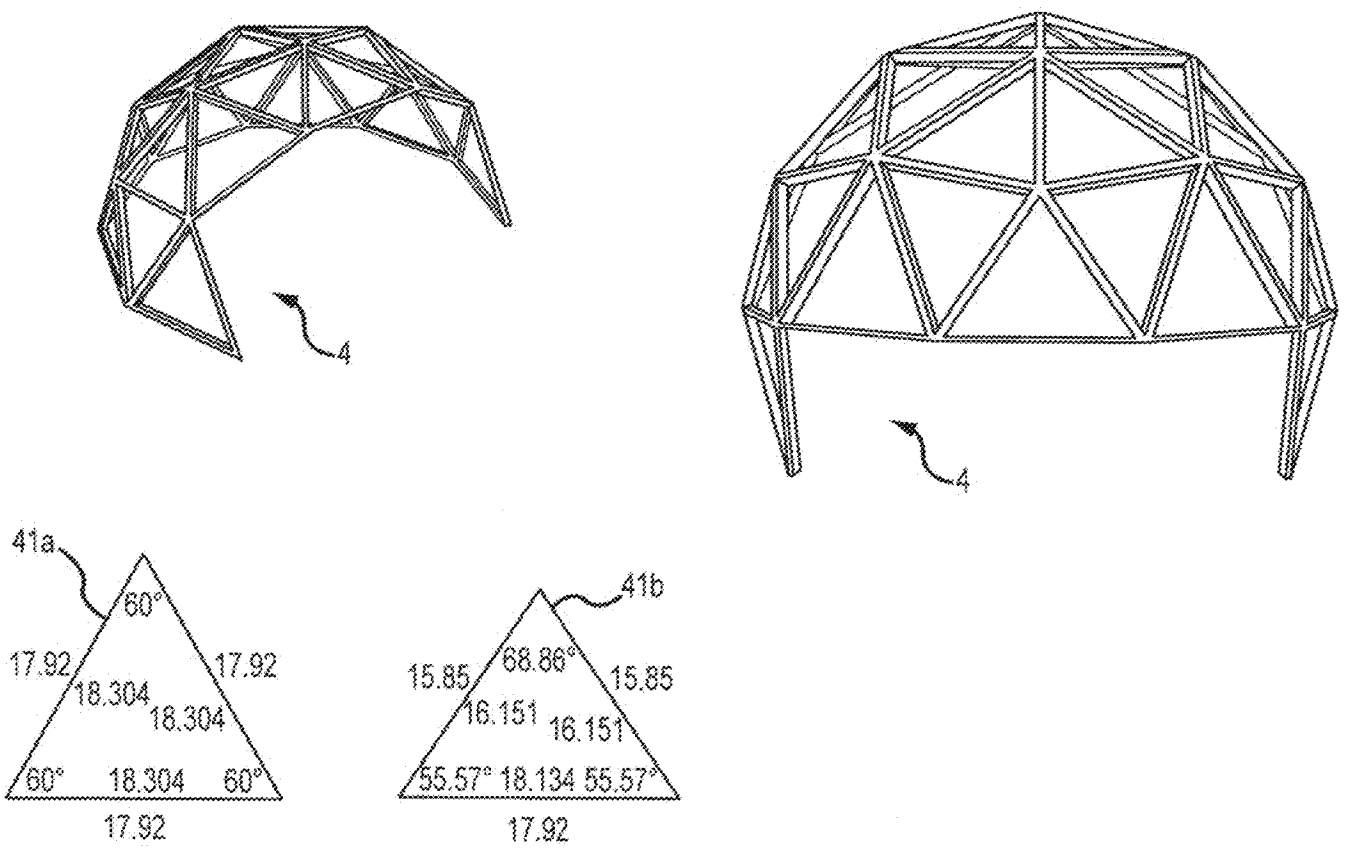
FIG. 5 shows one embodiment of the structural elements that construct an acoustical dome according to a first embodiment of the present invention.

FIG. 5 shows one embodiment of the geometric pieces 41 which make up the acoustical dome 4. Shown are component geometric pieces 41 from an embodiment in which the acoustical dome 4 is a geodesic dome comprising selectively interconnecting triangular geometric pieces 41. Two embodiments of the geometric pieces 41 necessary for construction of the dome 4 are shown. Eight large geometric pieces 41*a* and twenty small geometric pieces 41*b* are utilized to create the geodesic dome 4. In a preferred embodiment, the large geometric piece 41*a* is an equilateral triangle having a side length of 17.92 inches. Alternatively, the small geometric piece 41*b* is an isosceles triangle having a side length of 15.85 inches and a base length of 17.92 inches, wherein the angles between the base and the sides are both 55.57° and the angle between the two sides is 68.86°. While large 41*a* and small 41*b* geometric pieces are shown, one having skill in the art will recognize that the pieces may be a variety of sizes to either increase the number of pieces 41 or decrease the number of pieces 41 used in the dome 4.

Figure 6:
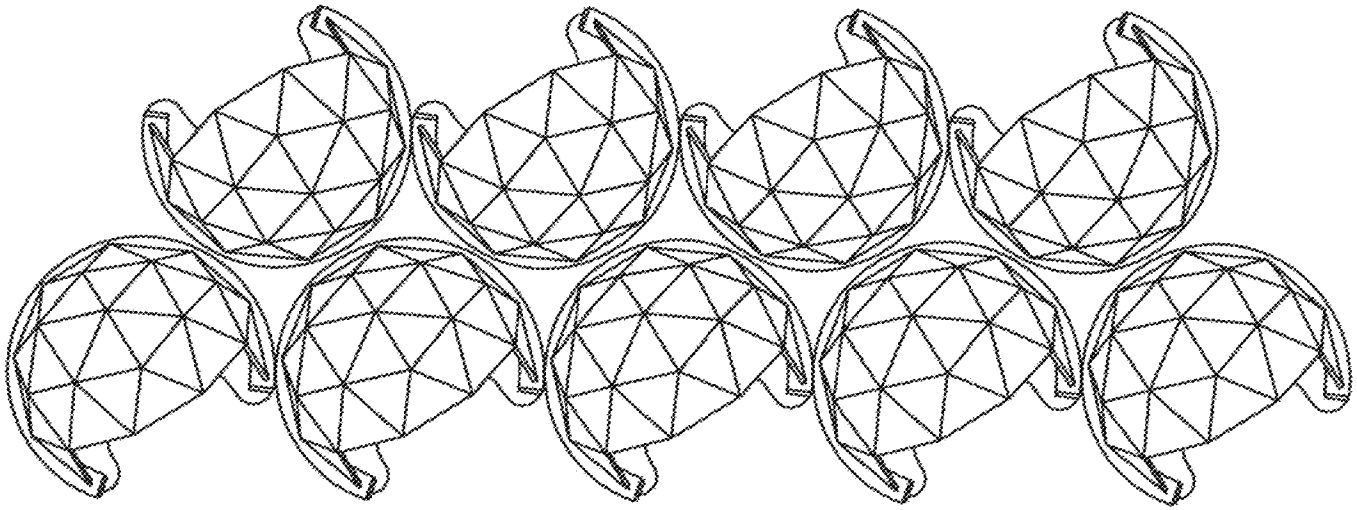
FIG. 6 shows an overhead view of one layout embodiment for the workstation embodiment of FIG. 1.
Figure 14:
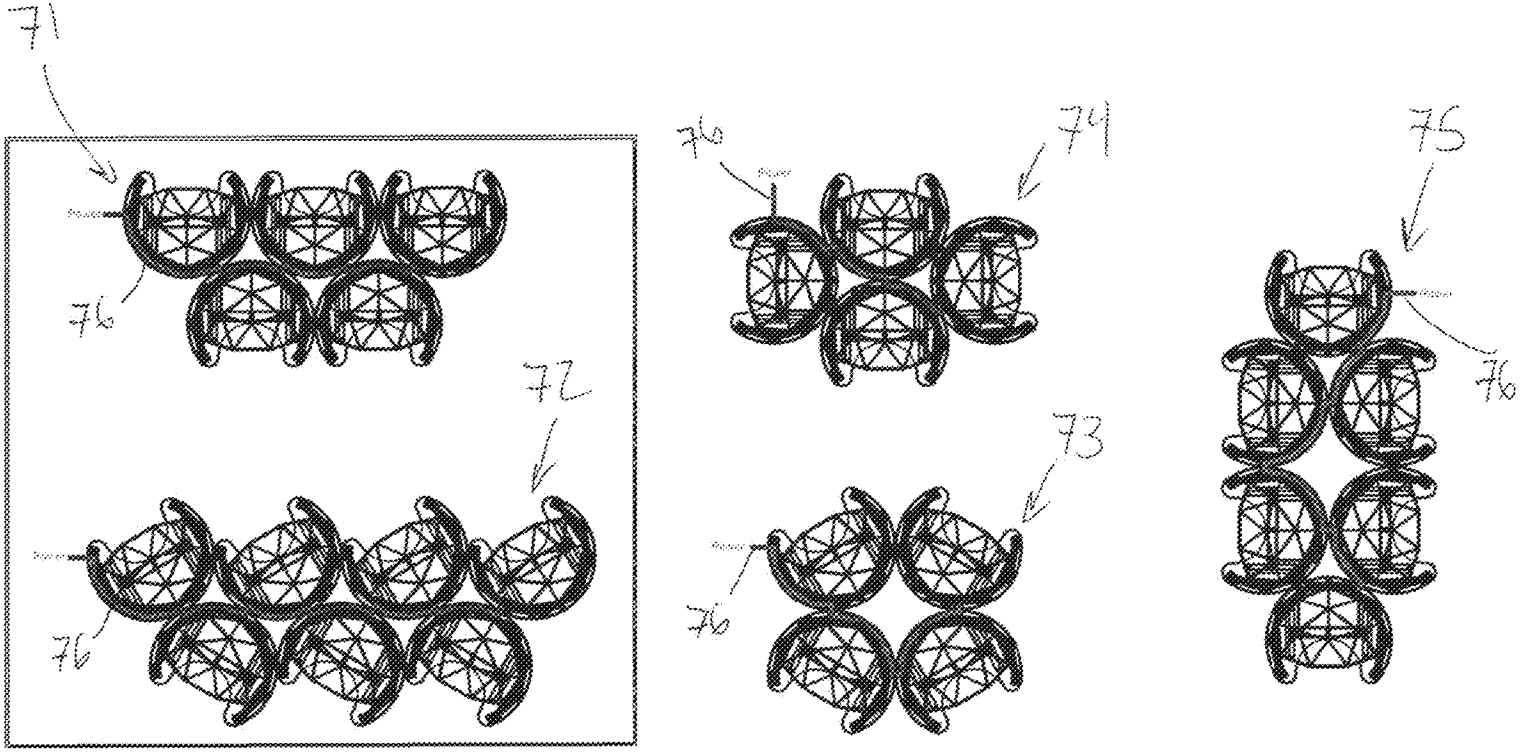
FIGS. 14*a*, 14*b*, 14*c*, and 14*d* show top, perspective, end, and side views, respectively, of a workstation including an acoustical privacy shield according to the embodiment illustrated in FIGS. 13*a* through 13*d;*

FIG. 6 depicts a novel workstation 1 layout for an open workspace environment utilizing the present invention. In a preferred embodiment, the workstations 1 may be arranged in a zigzag or offsetting arrangement. This arrangement allows for an efficient use of workspace in order to maximize the density of users without degrading the privacy of the users. Moreover, as will be shown in greater detail in FIGS. 7-8, this arrangement utilizes the raceway of each workstation 1 to interconnect the units and cut down on "pile-up" of electrical cords. This arrangement also provides a unique office aesthetic when the workstations are positioned at different heights. This customization allows both the users and employers to fully optimize their work environments.

FIG. 7 shows a plurality of alternative workstation 1 layouts and the electrical distribution pathways utilized to connect the workstations 1. These layouts may be described as zigzag opposing 71, zigzag offset 72, square 73, diamond 74, and oval 75. In a preferred embodiment, the zig-zag layouts 71, 72 are utilized. As shown, in each of the layouts 71,72,73,74,75 the electrical distribution pathway 76 is shown connecting the plurality of workstations 1. In a preferred embodiment, the electrical distribution pathway 76 makes a connection with each workstation no matter which layout 71,72,73,74,75 is utilized. However, one skilled in the art will recognize that a user may create unique layouts by utilizing two or more electrical distribution pathways 76 in one layout.

Figure 8:
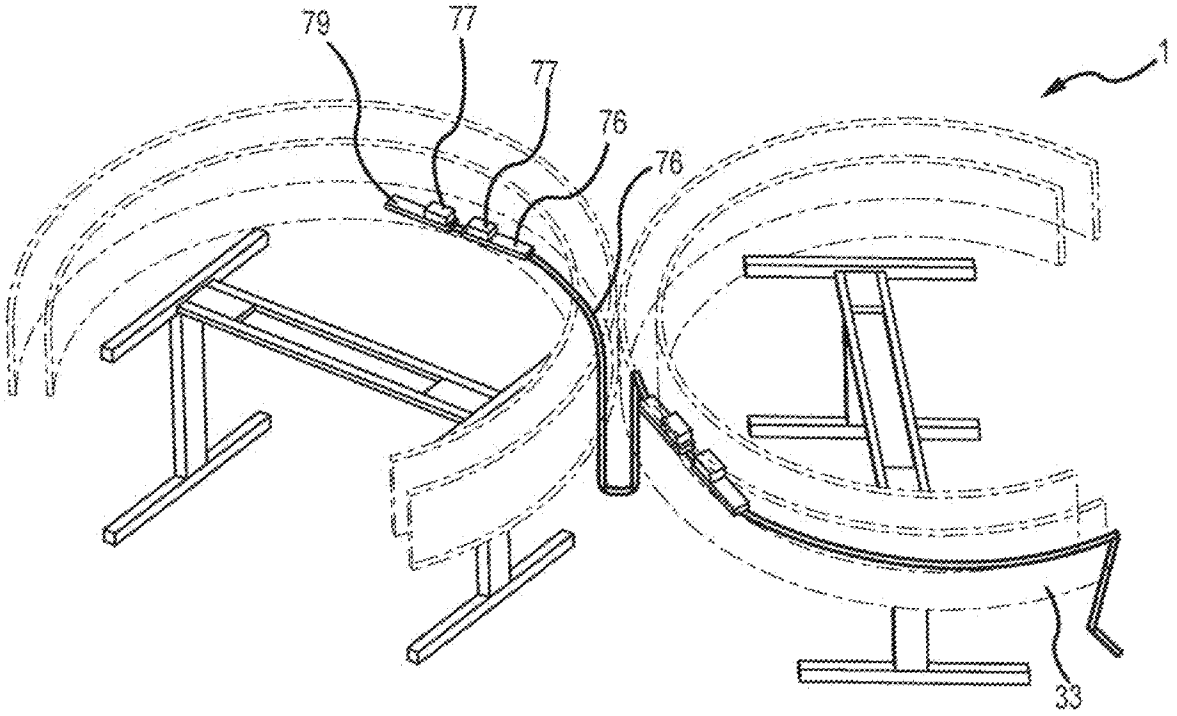
FIG. 8 shows a cross-sectional view of the raceway according to one embodiment of the present invention.

FIG. 8 provides a more detailed look at the raceway 33 which allows for the unique layouts described in FIG. 6. Shown are two workstations 1 connected via an electrical distribution pathway 76. As shown, the pathway 76 travels through the raceway 33 of each workstation 1 wherein the pathway 76 connects to an electrical outlet 77 before continuing to the next workstation 1. The electrical outlets 77 comprise two connectors 78,79 on each end which connect to the pathway 76 and allow it to continue to the next workstation 1. The pathway 76 continues until it reaches the last workstation 1 in the chosen layout.

Figure 9B:
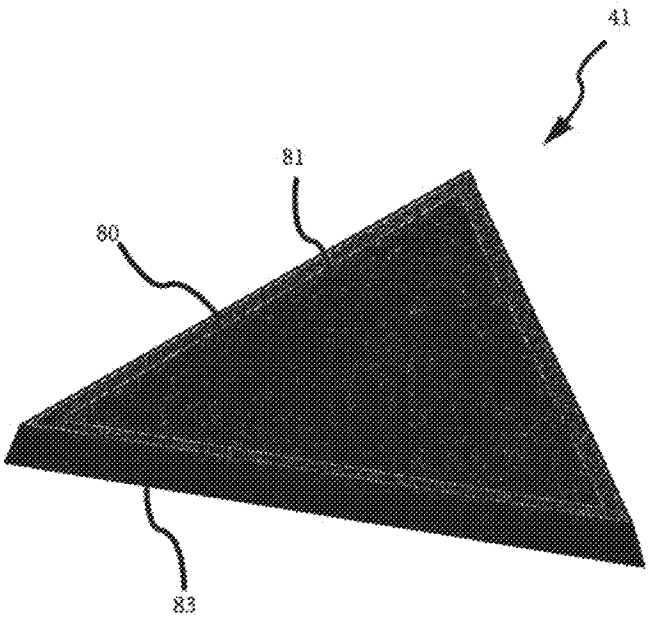
FIGS. 9*a* and 9*b* shows one embodiment of the structural elements which construct the acoustical dome both separated and assembled.
Figure 9A:
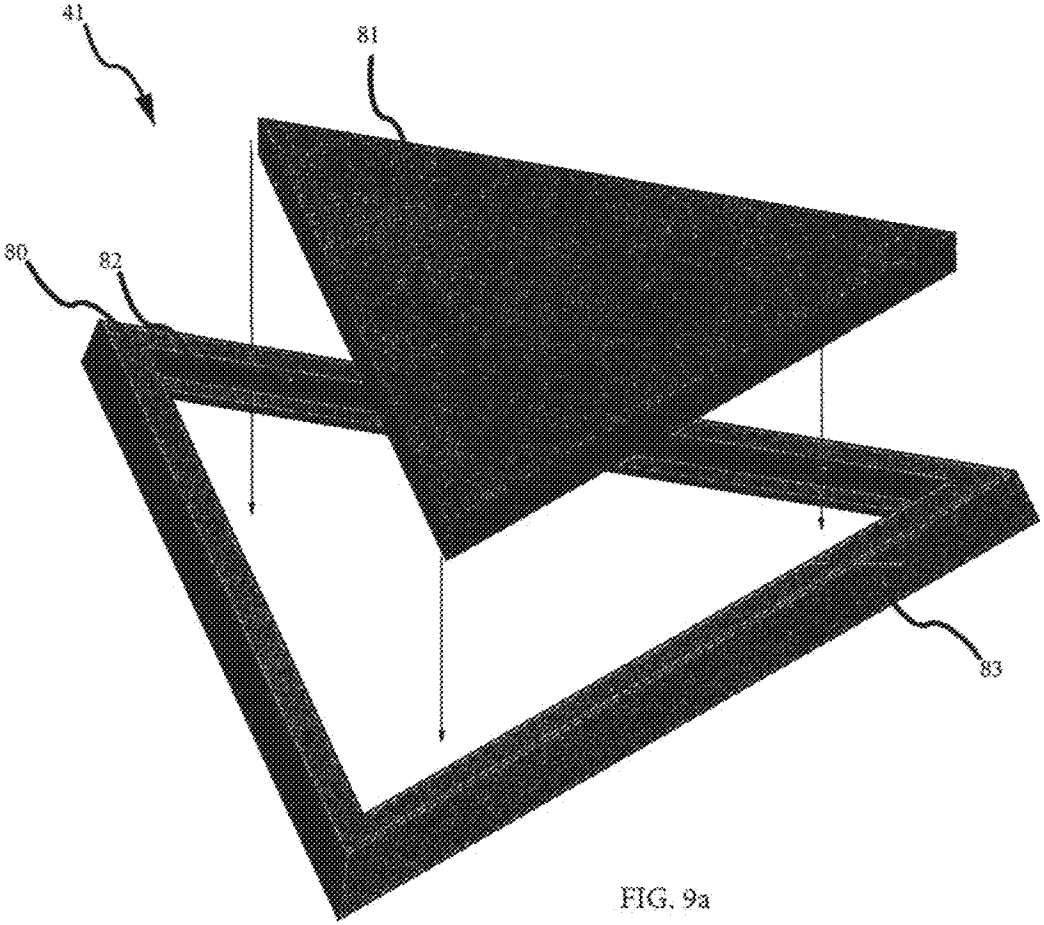

FIGS. 9*a* and 9*b* show one embodiment of the geometric pieces 41 shown in FIG. 5. More specifically, FIG. 9*a* shows the two component pieces, before assembly, which may make up the geometric piece 41: the geometric frame 80 and the geometric body 81. As shown, the geometric has a recessed cavity 82 which allows the geometric body 81 to nest comfortably in the frame 80 and keep it in position. FIG. 9*b* shows the geometric body 81 securely nested in the recessed cavity 82. Additionally, the frame further has a plurality of apertures 83 for connecting one geometric frame 80 to another. In one embodiment, the geometric body 81 is composed of foam or fabric. However, one having skill in the art will recognize that the geometric body 81 can be any number of materials suitable for constructing the geodesic dome, including but not limited to, metal, plastic, polymer, wood, electronic material (including display screens), cardboard, and glass. Similarly, the frame itself can also be constructed from any one or more of several materials, including but not limited to, metal, plastic, polymer, foam, wood, cardboard, and glass.

Figure 10A:
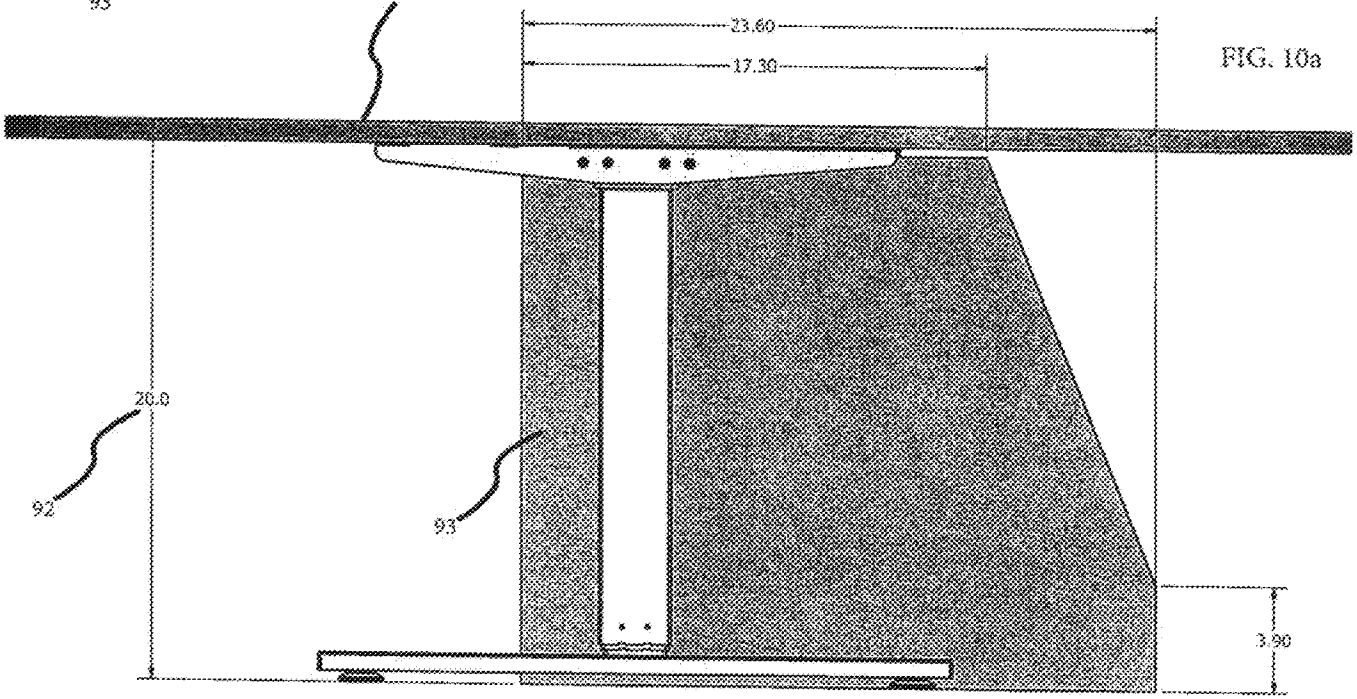
FIGS. 10*a* and 10*b* show a side view and perspective view of one embodiment of the desk portion of the workstation.
Figure 10B:
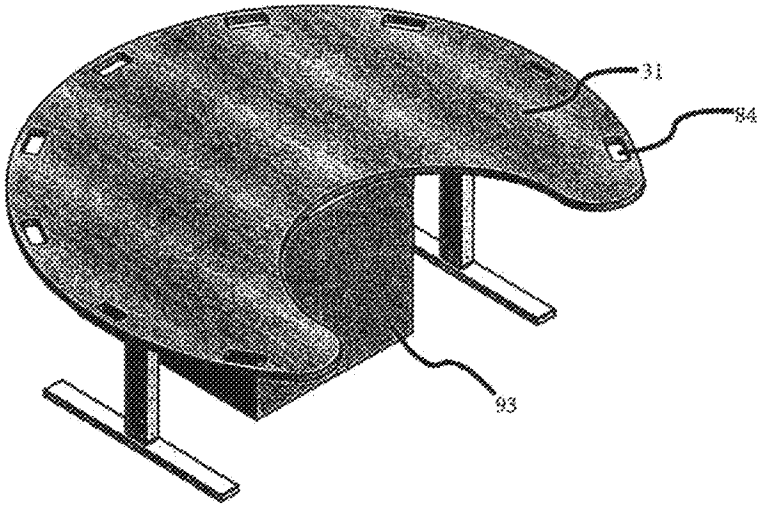

FIGS. 10*a* and 10*b* show two views of one embodiment of the present invention without the geodesic dome or raceway. The embodiment shown shows the workstation 1 with proper knee clearance 92 per ANSI Standards 8.3.2.1.2 for a 5% female in the seated position. FIGS. 10*a* and 10*b* further utilize an imaginary user clearance box 93 to visualize the required clearance for a 5% female in the seated position. Additionally, FIGS. 10*a* and 10*b* show cable receiving apertures 84. The raceway of the present invention rests on top of the work surface 31 such as to conceal the cable receiving apertures 84 and any cables which may be present.

Figure 11B:
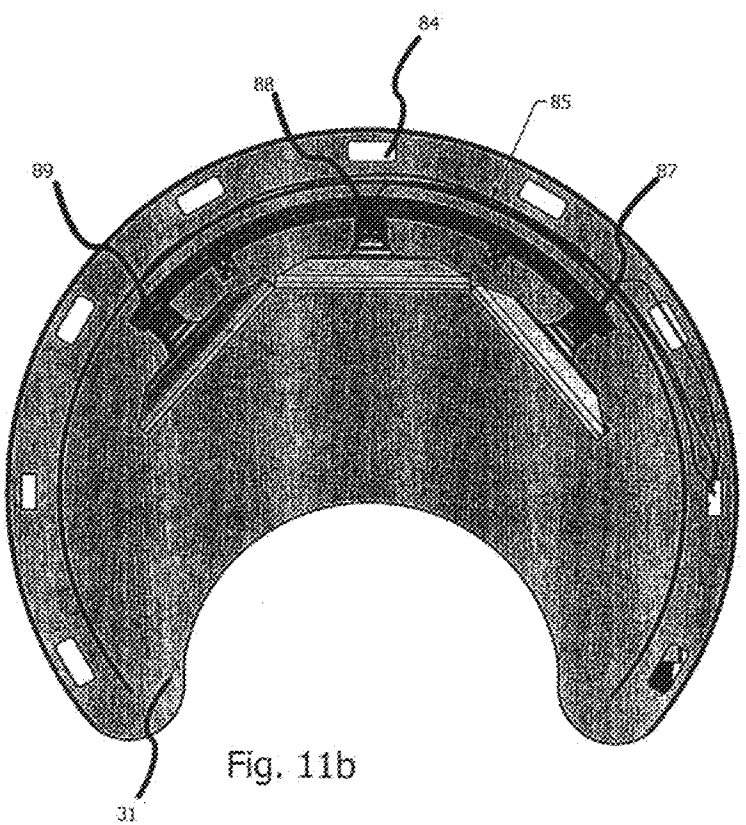
FIGS. 11*a* and 11*b* show a bottom view and top view of one embodiment of the raceway with cables.
Figure 11A:
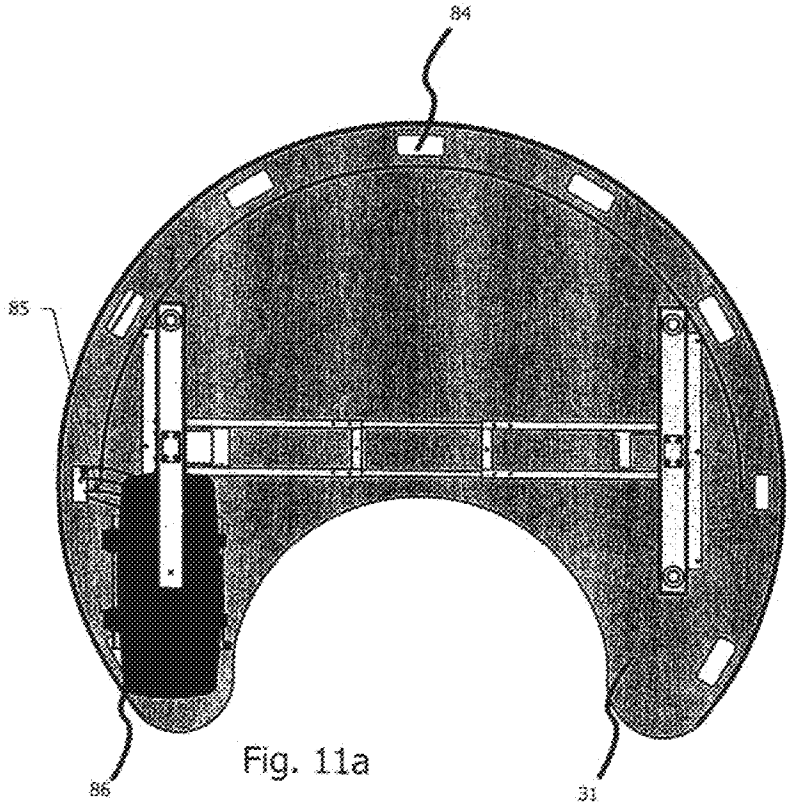

FIGS. 11*a* and 11*b* show a bottom view and top view, respectively, of one embodiment of the present invention without the geodesic dome. FIGS. 11*a* and 11*b* show, by way of non-limiting example, how the cable receiving apertures 84 are utilized in the present invention. FIG. 11*a* shows cables 85 extending from a first electronic device 86. The cables 85 extend through the cable receiving apertures 84 on the underside of the work surface 31 and emerge from the cable receiving apertures 84 on the top side of the work surface 31, shown in FIG. 11*b*. The cables 85 then extend from the cable receiving apertures 84 until they reach a second electronic device 87, third electronic device 88, fourth electronic device 89, and so on depending on the number of electronic devices utilized. One skilled in the art will appreciate that the number of cables 85 and electronic devices utilized can be adjusted based on the needs of the user.

Figure 12:
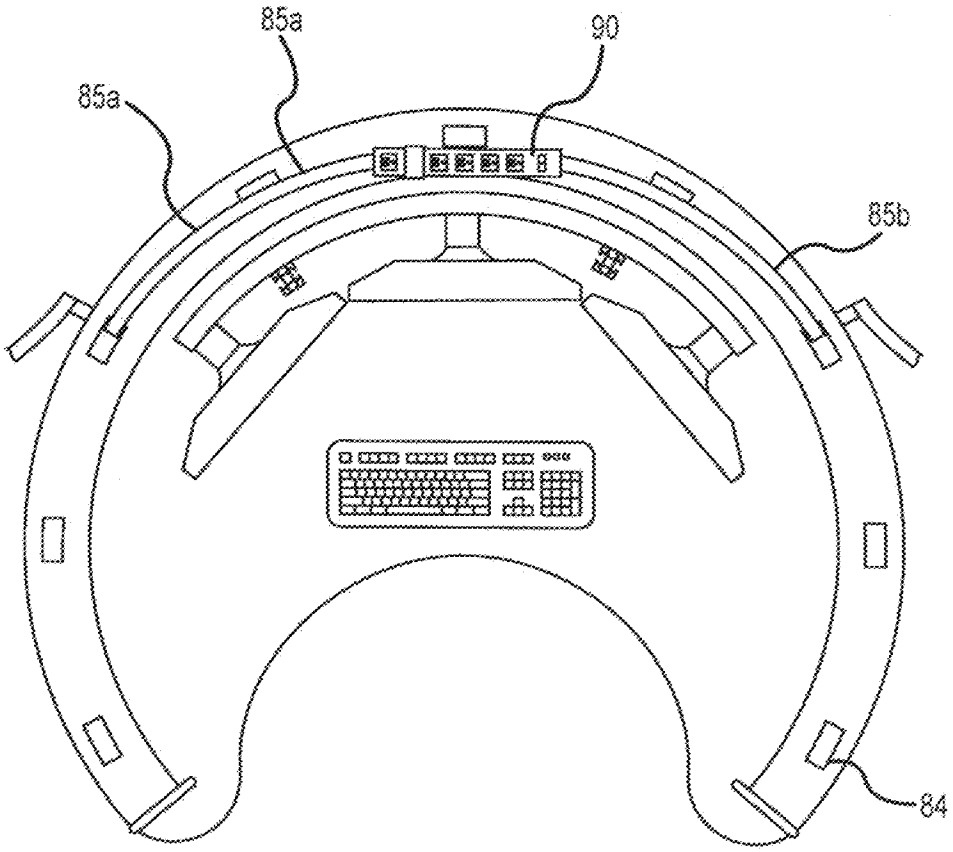
FIG. 12 shows a top view of one embodiment of receptacle block mounting location and routing.
Figure 13B:
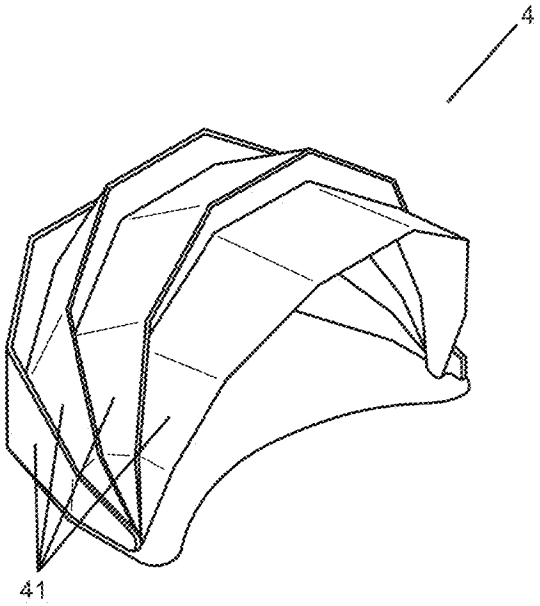
FIGS. 13*a*, 13*b*, 13*c*, and 13*d* show top, perspective, side, and end views, respectively, of the structural elements that construct an acoustical privacy shield according to a second embodiment of the present invention.
Figure 13A:
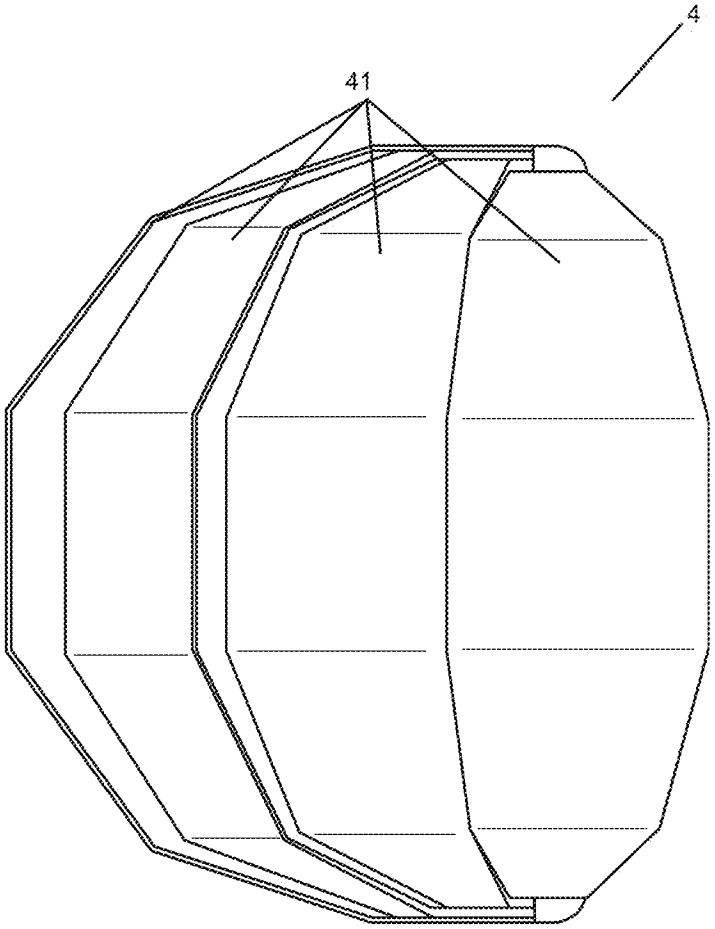
Figure 13D:
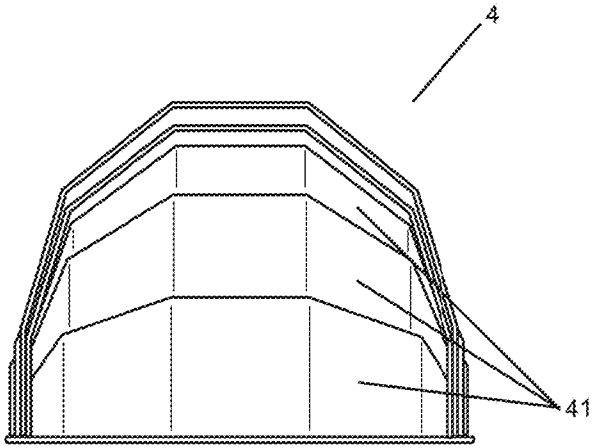
Figure 13C:
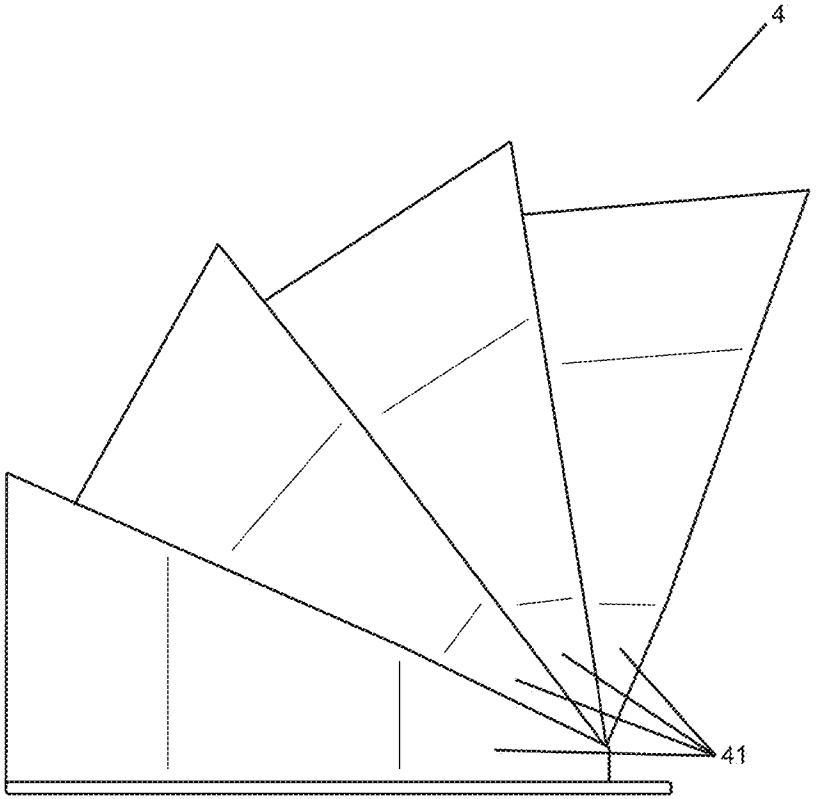
Figure 14A:
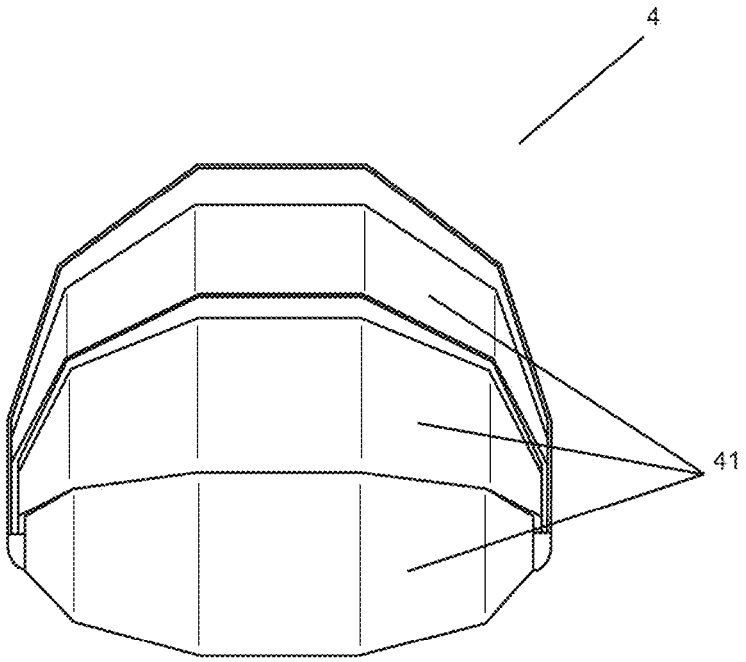
Figure 14B:
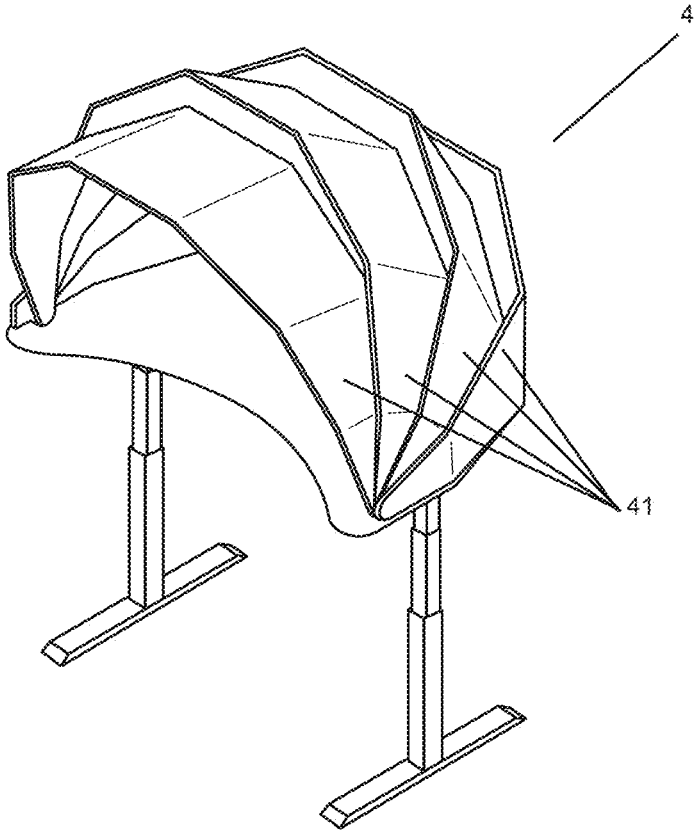
Figure 14D:
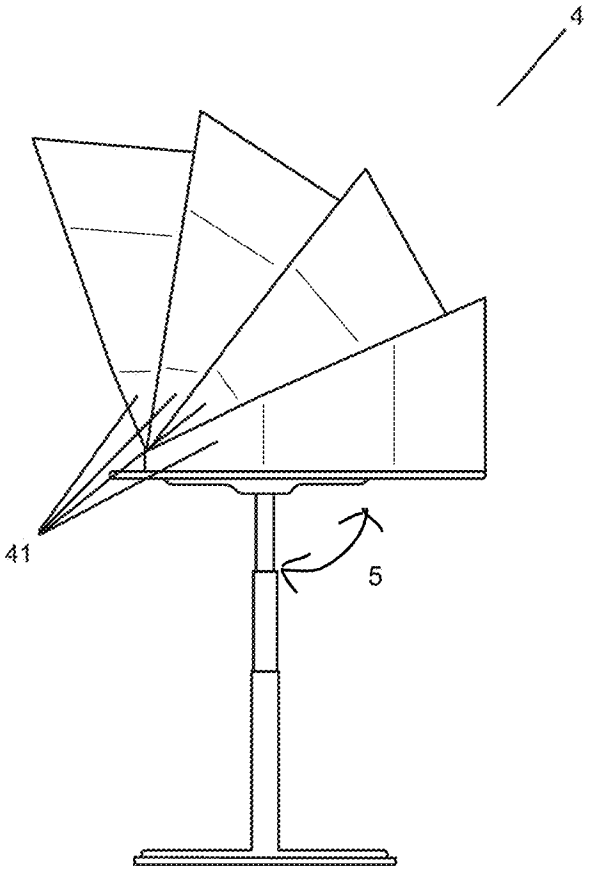
Figure 14C:
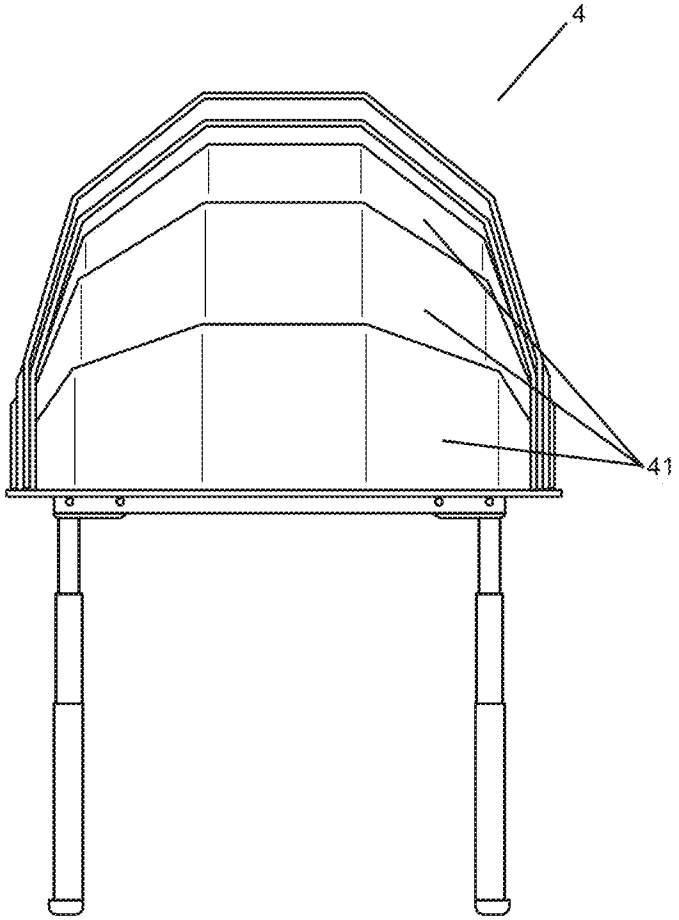
Figure 15A:
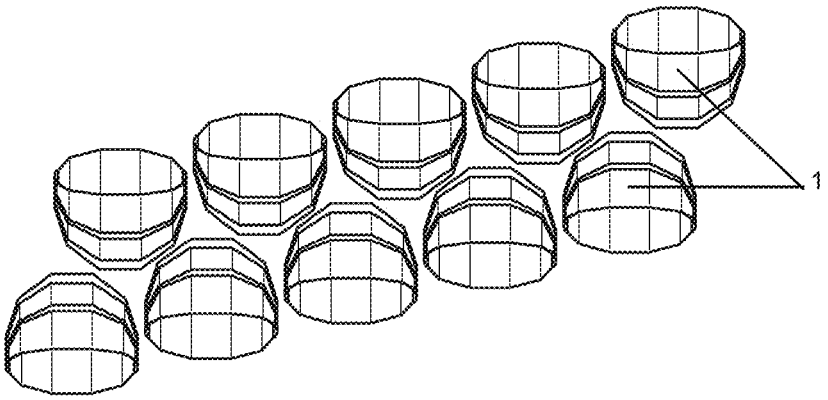
FIGS. 15*a*, 15*b*, 15*c*, and 15*d* show top, perspective, end, and side views, respectively, of one layout embodiment for workstations comprising acoustical privacy shields according to the embodiment illustrated in FIGS. 13*a* through 13*d;*
Figure 15B:
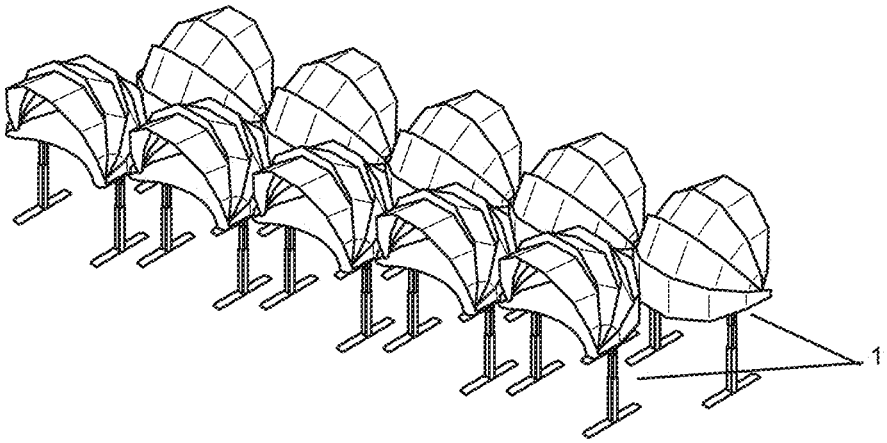
Figure 15C:
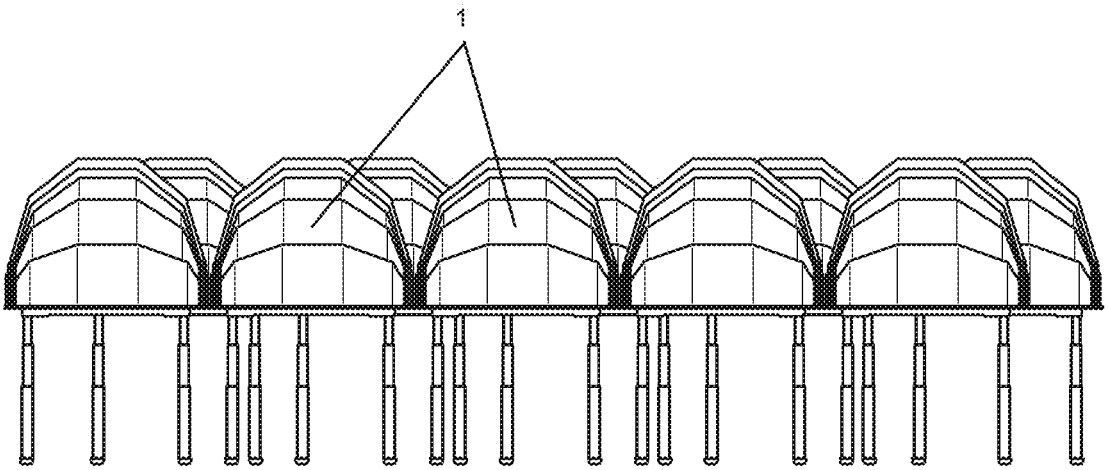
Figure 15D:
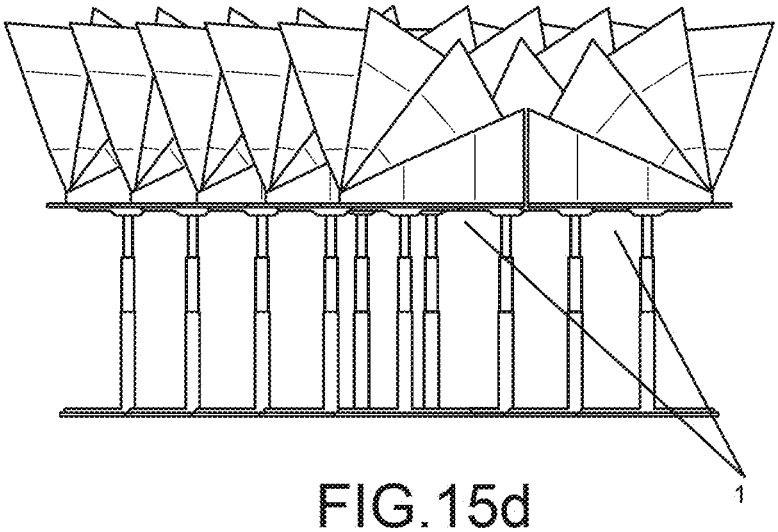
Figure 16B:
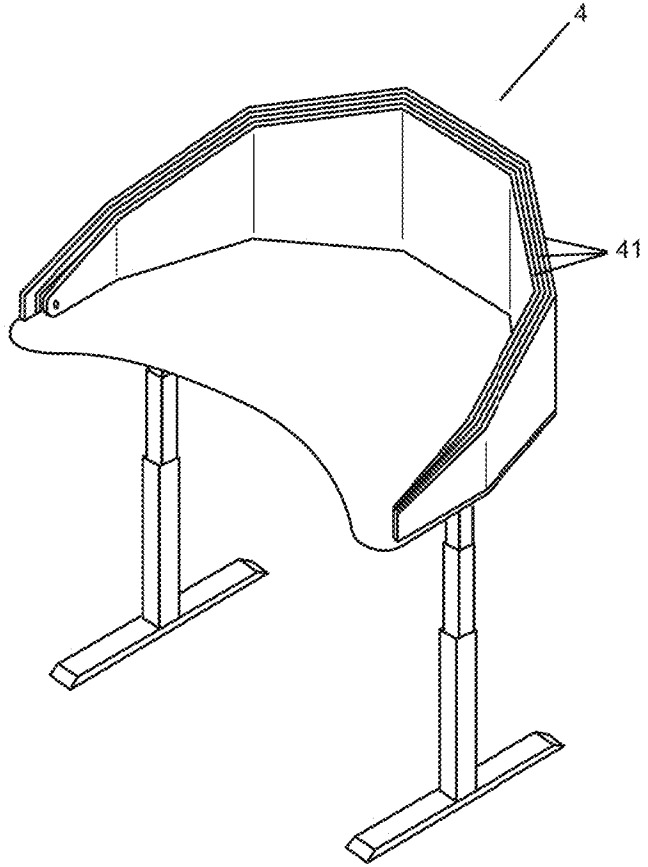
FIGS. 16*a*, 16*b*, 16*c*, and 16*d* show top, perspective, end, and side views, respectively, of a workstation including a selectively reconfigurable acoustical privacy shield according to an embodiment of the present invention, wherein the selectively reconfigurable acoustical privacy shield has been collapsed, lowered, or retracted.
Figure 16A:
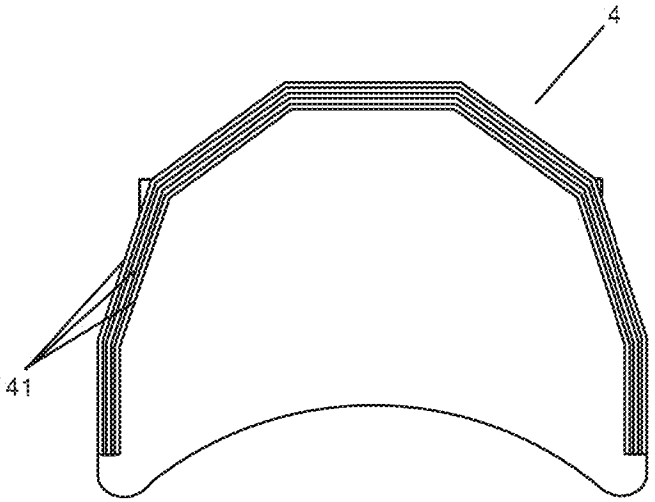
Figure 16D:
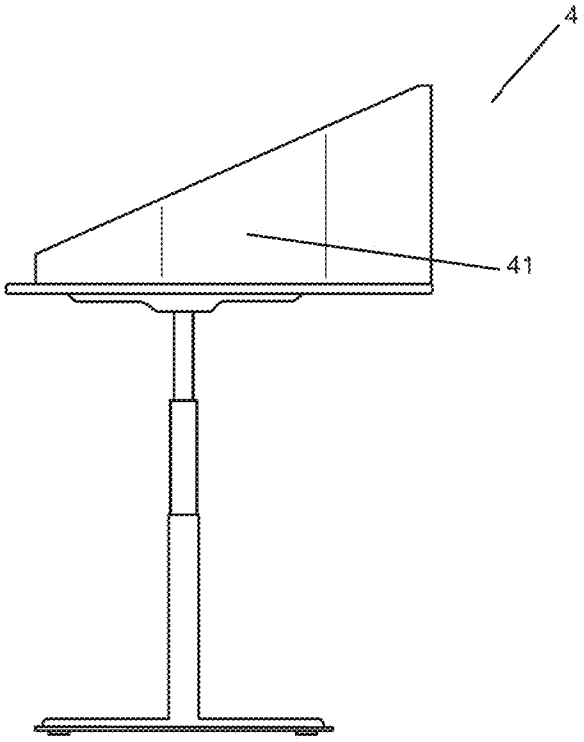
Figure 16C:
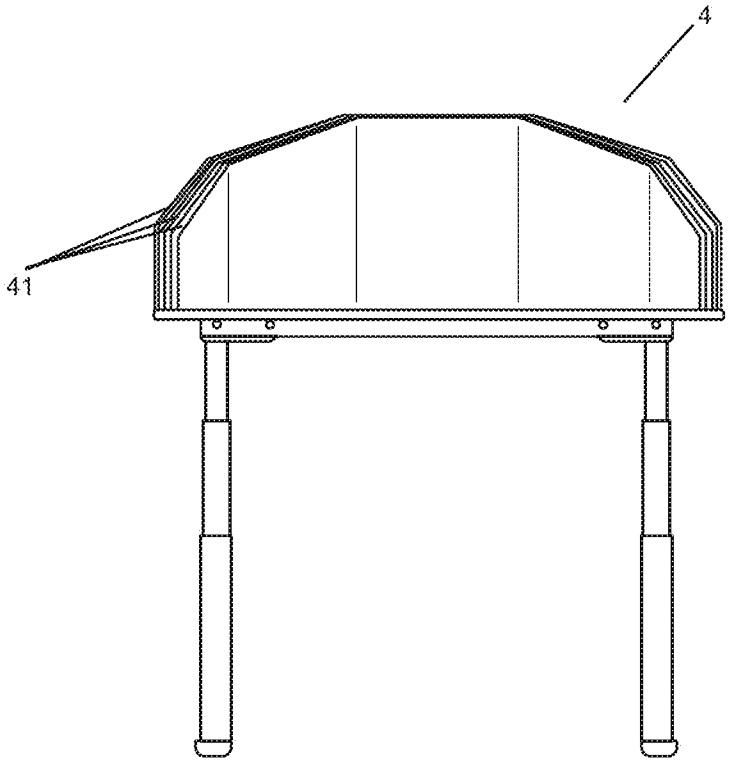
Figure 17B:
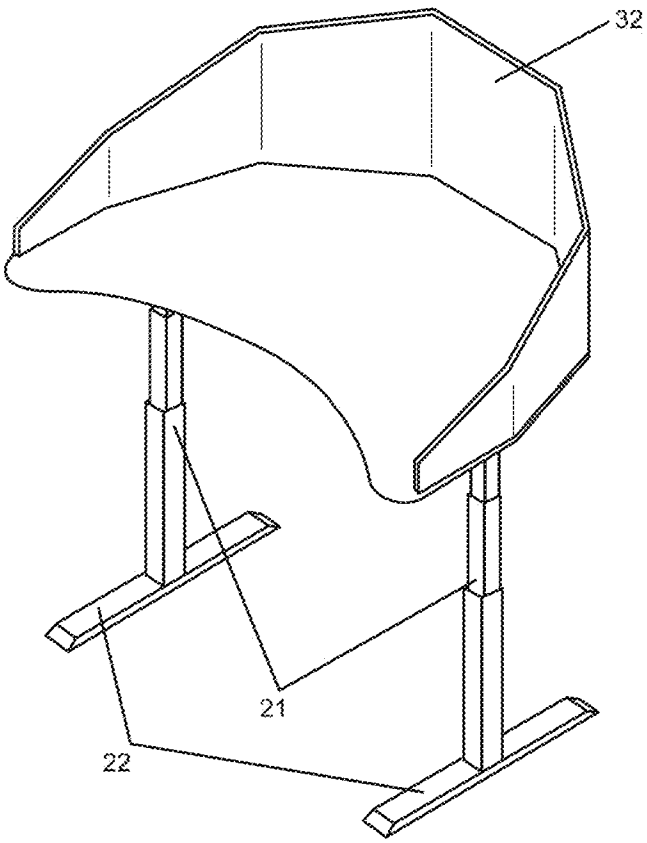
FIGS. 17*a*, 17*b*, 17*c*, and 17*d* show top, perspective, end, and side views, respectively, of a workstation without an acoustical privacy shield according to an embodiment of the present invention.
Figure 17A:
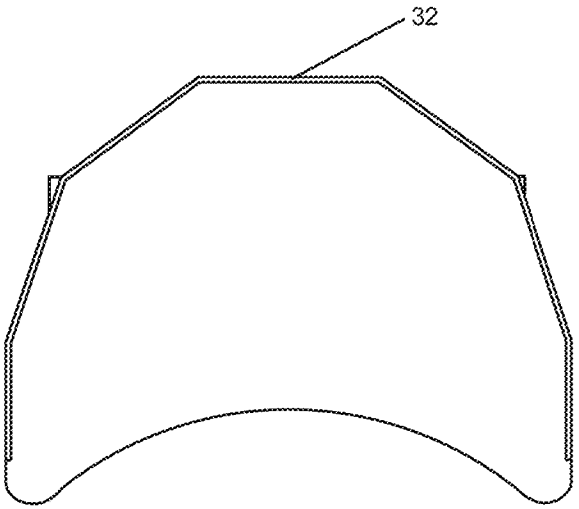
Figure 17D:
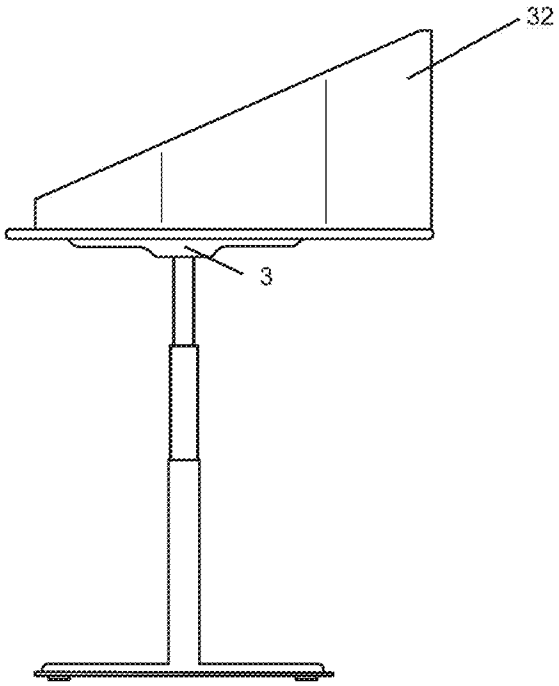
Figure 17C:
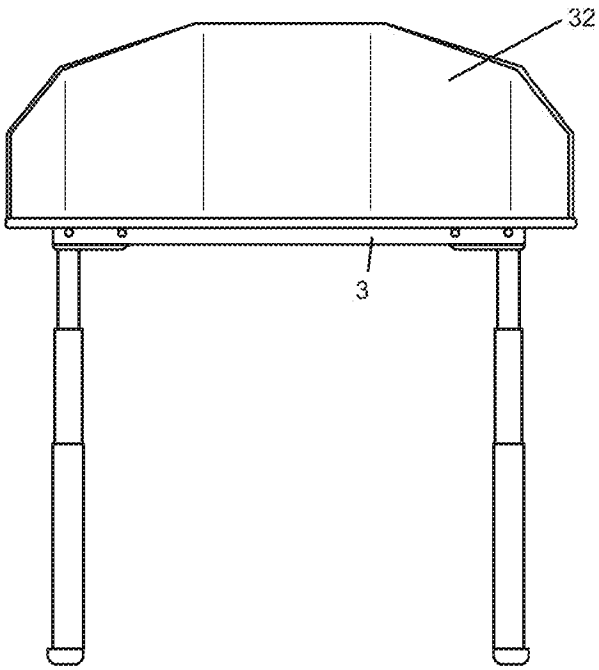

FIG. 12 shows another embodiment of the present invention without the geodesic dome in which a receptacle block 90 is utilized. As shown, a first cable portion 85*a* which connects multiple workstations together extends up through the cable receiving aperture 84 and proceeds until it connects with a receptacle block 90. The cable 85*b* then continues where it extends down through the cable receiving aperture 84 where it goes on to connect to another workstation. The use of the cables 85 places the workstations in electrical and data communication with one another. The receptacle block 90 may be a power strip having any number of electrical outlets which are utilized to connect one or more electronic devices based on the needs of the user.

FIGS. 13*a* through 14*d* show one embodiment of the acoustical dome 4 and of the geometric pieces 41 that make up the acoustical dome. The acoustical dome 4 shields the user from other users who may be located adjacent to the workstation 1. The acoustical dome 4 is constructed from selectively interconnecting geometric pieces 41. Shown are an acoustical dome 4 and component geometric pieces 41 thereof from an embodiment in which the acoustical dome 4 is a dome comprising arcuate pieces 41 which may, or may not, interconnect and/or be in flush physical contact with one another; in some embodiments, it may be desirable for the acoustical dome 4 to be constructed with gaps between at least one pair of adjacent pieces 41, e.g. to allow ambient light and/or airflow to enter the area of the workstation 1 from above the dome 4 while still maintaining visual and acoustic separation of the workstation 1 from the surrounding environment. In the embodiment illustrated in FIGS. 13*a* through 14*d*, each piece 41 comprises a plurality of rectangular or trapezoidal elements arranged in series; the pieces 41 are constructed such that each rectangular or trapezoidal element is disposed at a slight vertical angle relative to the succeeding rectangular or trapezoidal element, and such that a width or depth of each rectangular or trapezoidal element generally increases from the edge of the piece 41 toward the center. The overall effect of this construction is to provide each piece 41 with a generally arcuate shape that is narrowest at its edges (i.e. the lowest point, or "bottom," of the piece 41, disposed toward a periphery of the piece 41 and thus of the workstation 1) and widest at its center (i.e. the highest point, or "top," of the piece 41, disposed toward a center of the piece and thus of the workstation 1). However, one skilled in the art will recognize that the pieces 41 may be pentagonal, hexagonal, heptagonal, or any other geometric shape. Additionally, the acoustical dome may be created using a combination of two or more geometric pieces 41 with a different geometric shape, as in FIGS. 13*a* through 14*d* (where each piece 41 is a combination of rectangular elements and trapezoidal elements having varying shapes). Similarly, while an acoustical dome is a preferred embodiment of the present invention, one having skill in the art will recognize that the acoustical privacy shield 4 may be a cube, pyramid, cone, ellipse, or other shape based on the needs of the user, and that the pieces 41 may be of a variety of sizes to either increase or decrease the number of pieces 41 used in the dome 4. As shown, the dome 4 extends above, and optionally behind, the user to improve privacy.

FIGS. 15*a* through 15*d* depict a novel workstation 1 layout for an open workspace environment utilizing the present invention. In a preferred embodiment, the workstations 1 may be arranged in a zigzag or offsetting arrangement. This arrangement allows for an efficient use of workspace in order to maximize the density of users without degrading the privacy of the users. Moreover, this arrangement utilizes the raceway of each workstation 1 to interconnect the units and cut down on "pile-up" of electrical cords. This arrangement also provides a unique office aesthetic when the workstations are positioned at different heights. This customization allows both the users and employers to fully optimize their work environments.

FIGS. 16*a* through 16*d* depict an embodiment of the acoustical dome 4 illustrated in FIGS. 13*a* through 14*d* in which the acoustical dome is selectively reconfigurable between an expanded, raised, or extended configuration (as in FIGS. 13*a* through 14*d*) and a collapsed, lowered, or retracted configuration (as in FIGS. 16*a* through 16*d*). The selective reconfiguration of the acoustical dome 4 may be accomplished by a user of the workstation 1 by any suitable means; by way of non-limiting example, one or more pieces 41 of the acoustical dome 4 may be constructed so as to allow the user to move the pieces 41 by hand, and/or the acoustical dome 4 may be provided with one or more electrical and/or mechanical means (e.g. a servo motor) by which the pieces 41 may be moved between the configurations upon operation by the user of a button, switch, or other user input device of the workstation 1. It is to be expressly understood that, in some embodiments, the acoustical dome 4 and/or one or more pieces 41 thereof may, but need not, be reconfigurable into any number of positions intermediate between the fully expanded/raised/extended configuration (FIGS. 13*a* through 14*d*) and the fully collapsed/lowered/retracted configuration (FIGS. 16*a* through 16*d*). In many embodiments, it may be advantageous for the pieces 41 to be configured to "nest" within each other when in the fully collapsed/lowered/retracted configuration, as shown in FIGS. 16*a* through 16*d*, such that the pieces 41 occupy a minimal depth and/or area of the work surface 31 of the workstation 1.

Acoustical domes 4 and pieces 41 thereof according to any of the embodiments illustrated in FIGS. 13*a* through 16*d* may be constructed of any one or more suitable materials, including but not limited to carbon fiber, cardboard, electrically conductive materials (e.g. for a display screen), fabrics, foams, glass, metals, plastics, polymers, wood, and combinations and mixtures thereof. In some embodiments, it may be desirable for at least one, and optionally all, of the pieces 41 to be constructed primarily of a semi-rigid material to prevent deformation of the pieces 41, which may be particularly desirable, e.g., where the acoustical dome 4 is selectively reconfigurable and/or where the arrangement and relative position of the pieces 41 provides a particular functionality (e.g. to allow ambient light and/or airflow to enter the area of the workstation 1 from above the acoustical dome 4). Additionally or alternatively, it may be advantageous in some embodiments, e.g. where a cost or environmental footprint of manufacturing of the acoustical dome 4 is to be minimized, for at least one, and optionally all, of the pieces 41 to be constructed primarily of a recycled material, e.g. a recycled plastic or polymer. Those of ordinary skill in the art, in view of this disclosure, will understand how to select an appropriate material for a desired application.

FIGS. 17*a* through 17*d* depict the workstation 1 of FIGS. 16*a* through 16*d* without the acoustical dome. As shown, the base 2 includes two telescopic legs 21 each further having a support structure 22. However, one skilled in the art would recognize that various base 2 structures may be used, including non-telescopic legs of various heights, a various number of legs, legs of various widths including legs which also serve as drawers, and wall-like legs. The base 2 and body 3 may be part of one integral workstation 1, or the base 2 and body 3 may be selectively connectable for easy transportation. For example, in FIG. 14*d*, the angle 5 of the work surface 31 of the workstation 1 can be adjusted.

The workstation 1 may further include a modesty skirt 32 which is connected to the perimeter of the body 3 and extends around the perimeter of the body 3. One skilled in the art will appreciate that the modesty skirt 32 may be of various lengths and does not necessarily have to extend around the entire perimeter of the body 3. The modesty skirt 32 may be comprised of a plurality of materials including but not limited to various plastics, fabrics, polymers, metals, cardboard, or other materials which provide privacy for the user. The modesty skirt 32 may be transparent, opaque, or may be designed such that the transparency may be chosen by the user. The height of the modesty skirt 32 may be varied depending on the needs of the user and based on the position of the workstation 1 relative to other workstations. Additionally, the modesty skirt 32 may be selectively removable or collapsible such that a user may remove it if the modesty skirt 32 is not necessary. Additionally or alternatively, the modesty skirt 32 may serve as a structural support for an acoustical dome 4; by way of non-limiting example, a bottom or lower portion of the acoustical dome 4 may rest atop and/or interconnect with the modesty skirt 32, and/or, in embodiments in which the acoustical dome 4 is selectively reconfigurable as shown in FIGS. 16*a* through 16*d*, the modesty skirt 32 may serve as a back or rest for pieces 41 of the acoustical dome 4 when the acoustical dome 4 is selectively collapsed, lowered, or retracted. In embodiments in which the acoustical dome 4 is selectively reconfigurable and constructed of pieces 41 of generally arcuate shape with increasing width toward the center, e.g. as shown in FIGS. 13*a* through 14*d*, the modesty skirt 32 may have a similarly arcuate shape with an increasing height toward the center, such that pieces 41 of the acoustical dome 4 "fit" with, i.e. rest flush against and do not protrude above, the modesty skirt 32 when the acoustical dome is selectively collapsed, lowered, or retracted.

Figures 18A, 18B, 18C:
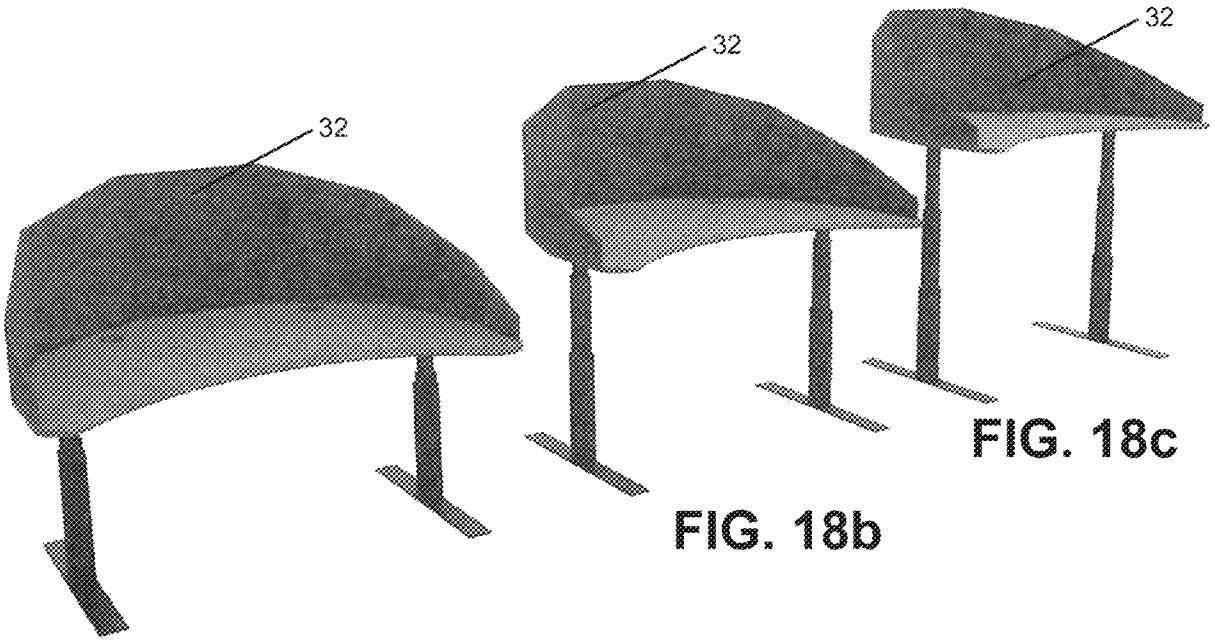
FIG. 18*a* is an illustration of an adjustable-height workstation, including a modesty skirt without an acoustical privacy shield, configured at a seated height, according to an embodiment of the present invention.
FIG. 18*b* is an illustration of an adjustable-height workstation, including a modesty skirt without an acoustical privacy shield, configured at an intermediate height, according to an embodiment of the present invention.
FIG. 18*c* is an illustration of an adjustable-height workstation, including a modesty skirt without an acoustical privacy shield, configured at a standing height, according to an embodiment of the present invention.
Figures 19A, 19B, 19C:
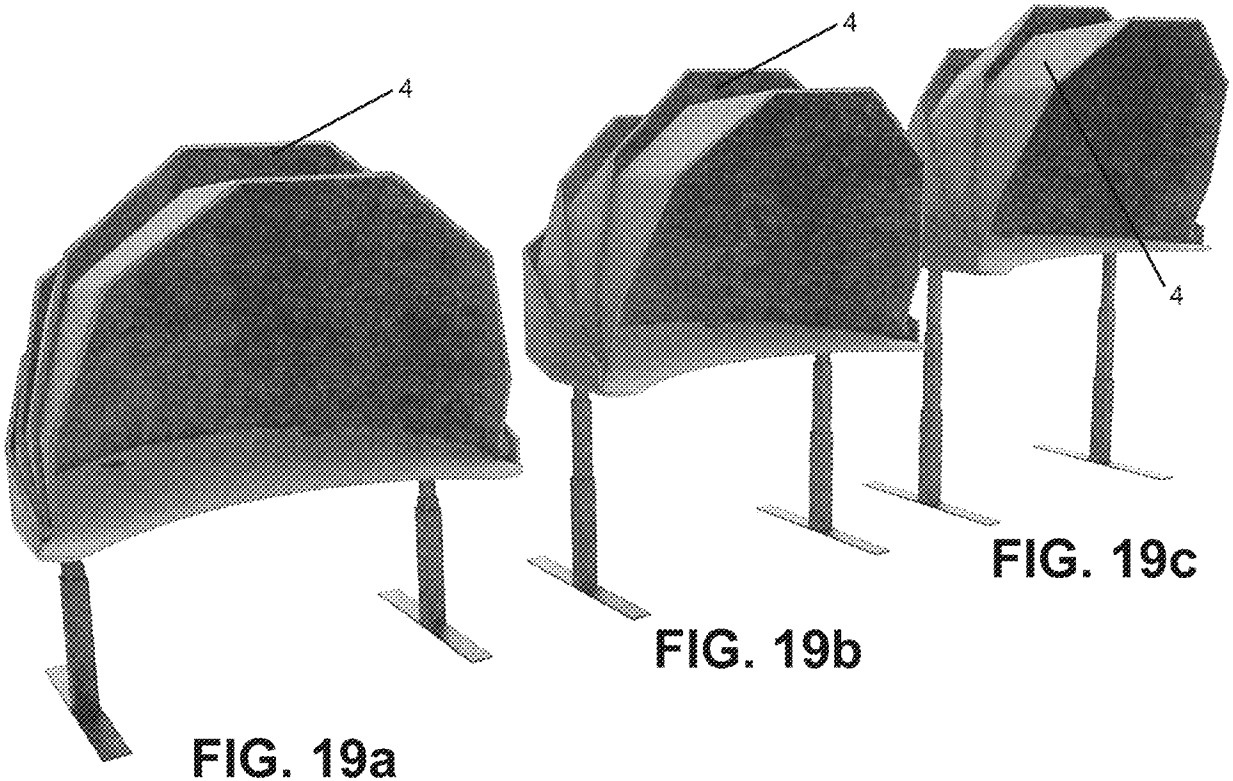
FIG. 19*a* is an illustration of an adjustable-height workstation, including a fixed acoustical privacy shield, configured at a seated height, according to an embodiment of the present invention.
FIG. 19*b* is an illustration of an adjustable-height workstation, including a fixed acoustical privacy shield, configured at an intermediate height, according to an embodiment of the present invention.
FIG. 19*c* is an illustration of an adjustable-height workstation, including a fixed acoustical privacy shield, configured at a standing height, according to an embodiment of the present invention.
Figures 20A, 20B, 20C:
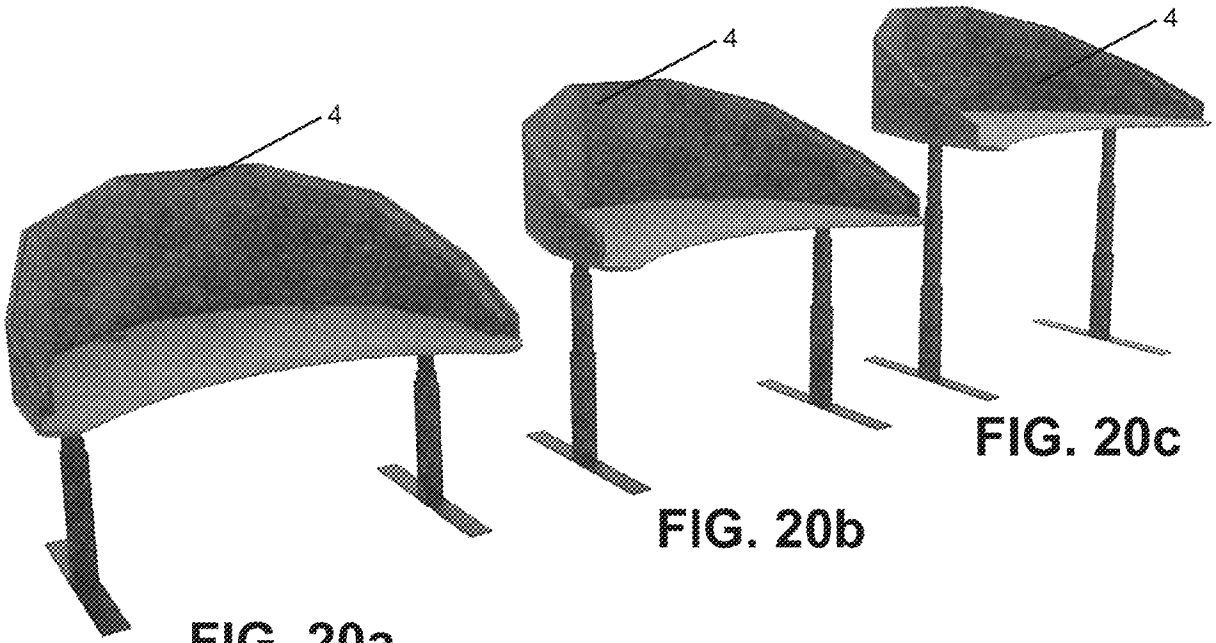
FIG. 20*a* is an illustration of an adjustable-height workstation, including a collapsible acoustical privacy shield, configured at a seated height, according to an embodiment of the present invention.
FIG. 20*b* is an illustration of an adjustable-height workstation, including a collapsible acoustical privacy shield, configured at an intermediate height, according to an embodiment of the present invention.
FIG. 20*c* is an illustration of an adjustable-height workstation, including a collapsible acoustical privacy shield, configured at a standing height, according to an embodiment of the present invention.

FIGS. 18*a*, 18*b*, 18*c*, 19*a*, 19*b*, 19*c*, 20*a*, 20*b*, and 20*c* show three adjustable-height embodiments of workstations 1 according to the present invention—one including only a modesty skirt 32 without an acoustical dome 4 (FIGS. 18*a-c*), one including a fixed acoustical dome 4 (FIGS. 19*a-c*), and one including a collapsible acoustical dome 4 (FIGS. 20*a-c*)—configured at a seated height (FIGS. 18*a*, 19*a*, 20*a*), an intermediate height (FIGS. 18*b*, 19*b*, 20*b*), and a standing height (FIGS. 18*c*, 19*c*, 20*c*). In these embodiments, the vertical height of the workstation 1 may be continuously adjustable, or discretely adjustable between predefined positions or "stops," by any suitable user-operable means, e.g. an electronic control, a hand crank, one or more gas springs, one or more mechanical springs and/or any suitable user-operable means for height adjustment.

Figure 21:
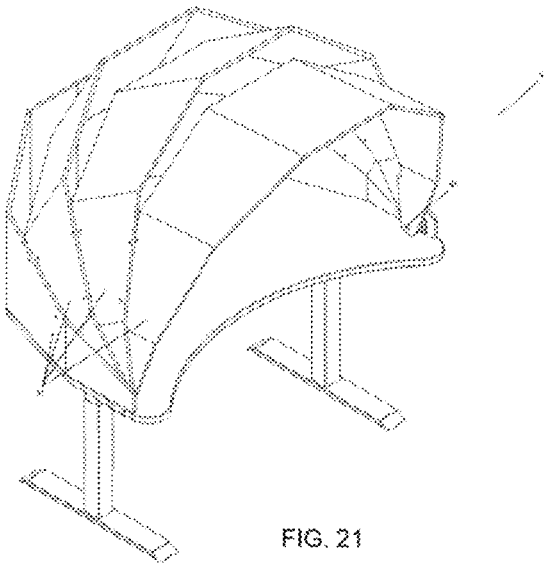
FIG. 21 is an illustration of fixation points at which segments of a fixed acoustical privacy shield are interconnected to each other, according to embodiments of the present invention.

FIG. 21 shows the workstation 1 comprising a fixed (non-collapsible) acoustical dome 4 illustrated in FIGS. 19*a-c*, and particularly the fixation points 42 at which each segment 41 is interconnected to adjacent segment(s) 41. It is to be expressly understood that such interconnections can be accomplished via any suitable means known to those of ordinary skill in the art, including but not limited to dowels, screws, bolts and nuts, rivets, etc.

Figure 22C:
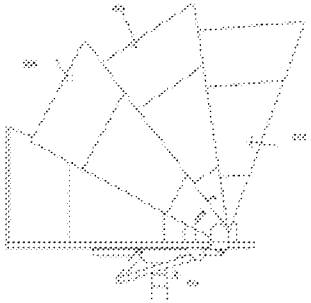
FIGS. 22*a*, 22*b*, and 22*c* are side views of a collapsible acoustical privacy shield in a collapsed position, an intermediate position, and a deployed position, respectively, according to embodiments of the present invention.
Figure 22B:
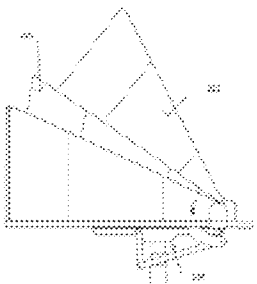
Figure 22A:
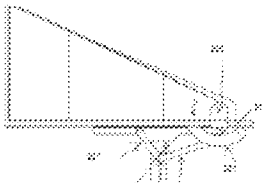
Figures 23A, 23B, 23C, 23D, 23E, 23F:
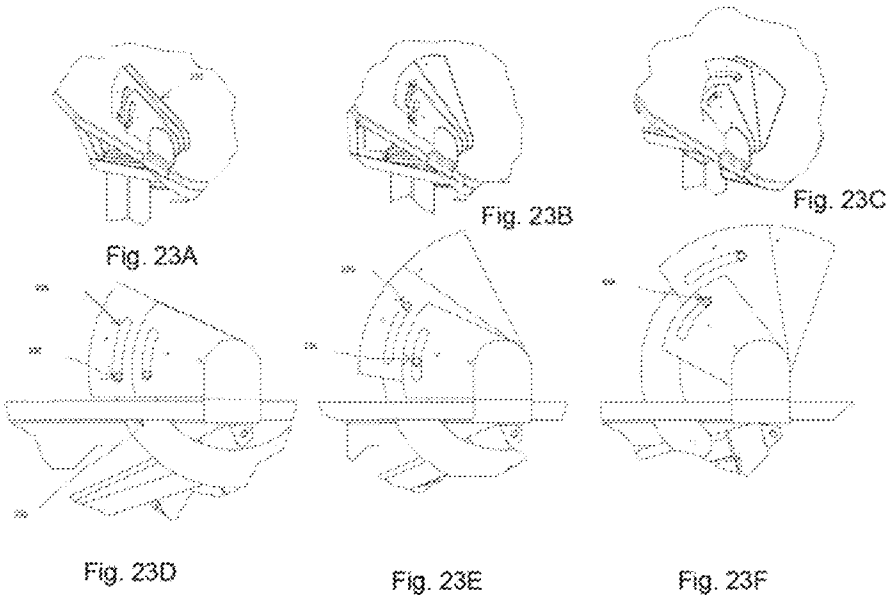
FIGS. 23*a*-23*f* are illustrations of a rotational bracket system interconnecting segments of an acoustical privacy shield, according to embodiments of the present invention.

FIGS. 22*a-c* show a side view of the collapsible acoustical dome 4 illustrated in FIGS. 20*a-c* in the collapsed position. As illustrated in FIG. 22*a*, a curved bracket 221 connects to the innermost of the dome segments, rotates on pivot 225, and passes through a slot in the work surface 31 to connect with a linkage system 227. An actuator 224, shown in a fully retracted position, is configured, when operated by a user, to push and/or pull the linkage at point 226 to rotate the innermost dome segment 222 between collapsed and deployed positions.

FIG. 22*b* shows the collapsible acoustical dome 4 in a position intermediate between the collapsed position and the deployed position. In FIG. 22*b*, the actuator 224 is pushing the linkage to rotate the innermost dome segment 222. When the innermost dome segment 222 has reached a predefined rotational position relative to the second-innermost dome segment 223, a groove and pin system in the dome brackets 221 engages and begins to rotate dome segment 223 into place.

FIG. 22*c* shows the collapsible acoustical dome 4 in a fully deployed position. Actuator 224 is fully extended, having rotated the innermost segment of the dome 222 into its fully deployed position. The innermost segment 222 lifts the second-innermost segment 223 and third-innermost segment 228 into their fully deployed positions when the pins in each segment of the brackets engage with the end of each slot in the adjacent bracket.

In embodiments, a linkage system may be provided on both sides of the acoustical dome 4, only one of which comprises an actuator, and the linkages may be interconnected by a bar that spans the work surface 31 and transfers the rotational force to the non-actuated side and linkage. This allows for symmetrical and even rotation of the innermost segment on both sides of the desk. Alternatively, synchronized actuators can be provided on each side of the dome (i.e. in association with each linkage system) for symmetrical rotation of the innermost segment.

FIG. 23*a* through 23*f* show the rotational bracket system which interconnects the dome segments. The innermost bracket 231 moves through a slot 232 in the work surface 31 to connect the innermost dome segment 222 to the actuated linkage system 227. A pin 233 attached to the innermost bracket 231 and protruding through the innermost dome segment 222 into the adjacent bracket and dome segment moves rotationally through a slot 234 in the second-innermost bracket 235 until it reaches the end of the slot, where the rotational movement of the innermost bracket is transferred to the second-innermost bracket 235. As the second-innermost bracket 235 rotates, a pin 236 fixed to the second-innermost bracket 235 rotates in a slot 237 in the third-innermost bracket 238 until it reaches the end of the slot 237, whereupon it transfers the rotational movement into the third-innermost bracket 238. The length of the slots establishes the rotational offset between segments, thereby assuring the correct position of each segment when the acoustical dome 4 is in the fully deployed configuration.

It is to be expressly understood that, although the embodiment illustrated in FIGS. 22*a*-23*f* is depicted as having three dome segments and thus a linkage system comprising three brackets, the same construction of dome segments and brackets can be utilized, mutatis mutandis, to provide a dome having any suitable number of segments and corresponding brackets. By way of non-limiting example, the number of segments (and thus brackets) in an adjustable acoustical dome 4 may be two, three, four, or any integer more than four, within the scope of the present invention.

In embodiments of the acoustical dome 4 according to the present invention, part or all of the acoustical dome 4 and/or associated components (e.g. the modesty skirt 32) may be partially or entirely made of a sound-absorbing material, e.g. polyethylene terephthalate (PET). By way of first non-limiting example, at least an outer (environment-facing) surface of the acoustical dome 4 may comprise a sound-absorbing material to reduce the degree of ambient noise perceived by a user of the workstation 1. By way of second non-limiting example, at least an inner (work surface-facing) surface of the acoustical dome 4 may comprise a sound-absorbing material to reduce the degree of noise generated by the user (e.g. by typing, conducting phone calls, etc.) perceived by persons in the environment surrounding the workstation 1. It is particularly advantageous for such sound-absorbing materials to be partially or entirely recycled or recyclable materials, which provides superior environmental benefits relative to the solutions of the prior art. Those of ordinary skill in the art will appreciate and understand how to select an appropriate sound-absorbing material for a desired application, based at least in part on budgetary considerations and a desired configuration or layout of workstation(s).

Embodiments of the acoustical dome 4 according to the present invention may take any of several suitable forms. By way of first non-limiting example, the acoustical dome 4 may be a single acoustical or visual barrier integrally affixed to the workstation 1 (e.g. similar to the modesty skirt 32). By way of second non-limiting example, the acoustical dome 4 may be a dome of fixed configuration, height, and/or orientation. By way of third non-limiting example, the acoustical dome 4 may be a collapsible dome actuated manually (i.e. by hand by a user). By way of fourth non-limiting example, the acoustical dome 4 may be a collapsible dome actuated by any of several mechanical means, including but not limited to one or more electrically operated linear actuators, a gear system, a gas spring, a mechanical spring, or any other suitable mechanism for reconfiguring the acoustical dome 4. In some collapsible embodiments of the acoustical dome 4, individual segments of the acoustical dome 4 may be interconnected to one another via any one or more suitable affixation means (e.g. bracket(s), a pin-and-slot mechanism(s), etc.), such that movement of only a single segment of the acoustical dome 4 between a collapsed position and an extended position (or vice versa) causes other segments of the acoustical dome 4 to be repositioned thereby. It is to be expressly understood that these and other embodiments are within the scope of the present invention.

FIGS. 24*a* through 24*d* show one embodiment of the acoustical dome 4 and of the geometric pieces 41 that make up the acoustical dome, and FIG. 25 shows the sections 240*a,b,c* and connectors 241 of a single piece 41 of this embodiment in exploded view. The acoustical dome 4 shields the user from other users who may be located adjacent to the workstation 1. The acoustical dome 4 is constructed from selectively interconnecting geometric pieces 41. Shown are an acoustical dome 4 and component geometric pieces 41 thereof from an embodiment in which the acoustical dome 4 is a dome comprising arcuate pieces 41 which may, or may not, interconnect and/or be in flush physical contact with one another; in some embodiments, it may be desirable for the acoustical dome 4 to be constructed with gaps between at least one pair of adjacent pieces 41, e.g. to allow ambient light and/or airflow to enter the area of the workstation 1 from above the dome 4 while still maintaining visual and acoustic separation of the workstation 1 from the surrounding environment. In the embodiment illustrated in FIGS. 24*a* through 25, each piece 41 comprises a plurality of rectangular or trapezoidal elements arranged in series; the pieces 41 are constructed such that each rectangular or trapezoidal element is disposed at a slight vertical angle relative to the succeeding rectangular or trapezoidal element, and such that a width or depth of each rectangular or trapezoidal element generally increases from the edge of the piece 41 toward the center. The overall effect of this construction is to provide each piece 41 with a generally arcuate shape that is narrowest at its edges (i.e. the lowest point, or "bottom," of the piece 41, disposed toward a periphery of the piece 41 and thus of the workstation 1) and widest at its center (i.e. the highest point, or "top," of the piece 41, disposed toward a center of the piece and thus of the workstation 1). However, one skilled in the art will recognize that the pieces 41 may be pentagonal, hexagonal, heptagonal, or any other geometric shape. Additionally, the acoustical dome may be created using a combination of two or more geometric pieces 41 with a different geometric shape, as in FIGS. 24*a* through 25 (where each piece 41 is a combination of rectangular elements and trapezoidal elements having varying shapes). Similarly, while an acoustical dome is a preferred embodiment of the present invention, one having skill in the art will recognize that the acoustical privacy shield 4 may be a cube, pyramid, cone, ellipse, or other shape based on the needs of the user, and that the pieces 41 may be of a variety of sizes to either increase or decrease the number of pieces 41 used in the dome 4. As shown, the dome 4 extends above, and optionally behind, the user to improve privacy.

Acoustical domes 4 and pieces 41 thereof according to the embodiment illustrated in FIGS. 24*a* through 25 may be constructed of any one or more suitable materials, including but not limited to carbon fiber, cardboard, electrically conductive materials (e.g. for a display screen), fabrics, foams, glass, metals, plastics, polymers, wood, and combinations and mixtures thereof. In some embodiments, it may be desirable for at least one, and optionally all, of the pieces 41 to be constructed primarily of a semi-rigid material to prevent deformation of the pieces 41, which may be particularly desirable, e.g., where the acoustical dome 4 is selectively reconfigurable and/or where the arrangement and relative position of the pieces 41 provides a particular functionality (e.g. to allow ambient light and/or airflow to enter the area of the workstation 1 from above the acoustical dome 4). Additionally or alternatively, it may be advantageous in some embodiments, e.g. where a cost or environmental footprint of manufacturing of the acoustical dome 4 is to be minimized, for at least one, and optionally all, of the pieces 41 to be constructed primarily of a recycled material, e.g. a recycled plastic or polymer. Those of ordinary skill in the art, in view of this disclosure, will understand how to select an appropriate material for a desired application.

The embodiment of the acoustical dome 4 illustrated in FIGS. 24*a* through 25 differs from the embodiment of the acoustical dome 4 illustrated in FIGS. 13*a* through 14*d* in that the pieces 41 that make up the acoustical dome 4 are not of unitary construction, as in FIGS. 13*a* through 14*d*. Rather, in the embodiment illustrated in FIGS. 24*a* through 25, each piece 41 comprises a plurality of sections, in this case three sections 240*a,b,c*, which are joined together after manufacture by connectors 241. This alternative construction provides several important advantages and benefits. Particularly, the present inventors have discovered that where the acoustical dome 4 is intended to be used in conjunction with a particularly wide workstation 1, e.g. a workstation 1 including two or three large computer monitors arranged in a single row, it may be impossible or impractical to manufacture unitary pieces 41 having sufficient length to span the entire width of the workstation 1 out of a selected material. To remedy this, the embodiment illustrated in FIGS. 24*a* through 25 allows each piece 41 to be manufactured as a plurality of sections, in this case three sections 240*a,b,c*, that are joined together after manufacture; this allows each section to have a length that is practical for manufacture. It is to be expressly understood that pieces 41 of acoustical domes 4 according to the embodiment illustrated in FIGS. 24*a* through 25 may have any number of sections 240 equal to or greater than two, e.g. two, three, four, or greater than four.

In the embodiment illustrated in FIGS. 24*a* through 25, the connector 241 is a substantially rigid elongate component that is "bent" or "kinked" at such an angle as to provide for a corresponding angle of engagement between adjacent sections 240*a,b* and 240*b,c* of each piece 41. One non-limiting example of such a connector 241, as illustrated in FIGS. 24*a* through 25, is a "clip"-type connector that engages notches 242 provided in each section and thus slips onto each section 240 to a sufficient depth to hold each section 240 securely, but it is to be expressly understood that any suitable type of connector or fastener, as will be known in the art, may be employed to affix, fasten, or interconnect the sections 240 of each piece 41 to one another. One non-limiting example of a suitable method for manufacturing connectors 241 is injection molding, i.e. where the connector 241 is made of a plastic material, but any suitable material or manufacturing method for connector 241 may be employed; in all cases, however, connectors 241 should be constructed to have sufficient rigidity, tensile strength, etc. to hold the sections 240 of each piece 41 in place without breaking or otherwise failing as a result of the weight of each section 240.

In the embodiment illustrated in FIGS. 24*a* through 25, the outermost piece 410 of the acoustical dome 4 may be affixed, by any suitable means, to an outer edge of a perimeter of the body 3 of the workstation 1. Such a construction allows a bottom edge of the outermost piece 410 to extend below the work surface 31 to provide a modesty block for the operator and/or to better conceal cables or other electrical or mechanical components underneath the work surface 31.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described hereinabove is further intended to explain the best mode presently known of practicing the invention and to enable others skilled in the art to utilize the invention as such, or in other embodiments, and with the various modifications required by their particular application or uses of the invention.

What is claimed is:

1. A workstation, comprising:

an adjustable height desk having a work surface, an acoustical dome privacy shield connected to the work surface and interconnected to said desk and configured to substantially cover at least half of said work surface;

wherein said acoustical dome privacy shield comprises a plurality of sections, each section comprising at least one rectangular or trapezoidal element, wherein the plurality of sections are adapted to be securely and pivotally affixed to one another by a connector;

wherein the acoustical dome privacy shield is selectively removable from the work surface, and wherein the plurality of sections have gaps between them to allow ambient light and/or airflow through said gaps.

2. The workstation as set forth in claim 1, wherein said acoustical dome privacy shield is insulated on an interior side of the acoustical dome privacy shield with sound absorbing material.

3. The workstation as set forth in claim 1, wherein said acoustical dome privacy shield selectively interconnects with said desk.

4. The workstation as set forth in claim 1, wherein said acoustical dome privacy shield provides acoustic and visual privacy to a user.

5. The workstation as set forth in claim 1, wherein said desk further includes a plurality of built-in accessories and is adapted to accommodate a multiple circuit electrical distribution system to permit the use of power strips.

6. The workstation of claim 1, further comprising a modesty shield interconnected to said desk.

7. The workstation of claim 1, wherein said desk is in electrical communication with a plurality of other workstations, wherein said plurality of workstations are interconnected by cables.

8. The workstation of claim 1, wherein an angle of the work surface of said workstation is adjustable.

9. The workstation of claim 1, further comprising a rotational bracket interconnecting the plurality of segments and that is adapted to move the plurality of sections between a collapsed and a deployed position.

10. A workstation, comprising:

an adjustable height desk having a work surface, an acoustical dome privacy shield connected to the work surface and interconnected to said desk and configured to substantially cover at least half of said work surface;

wherein said acoustical dome privacy shield comprises a plurality of sections, each section comprising at least one rectangular or trapezoidal element, wherein the plurality of sections are adapted to be securely and pivotally affixed to one another by a connector;

a rotational bracket interconnecting the plurality of segments and that is adapted to move the plurality of sections between a collapsed and a deployed position and wherein the plurality of sections have gaps between them to allow ambient light and/or airflow through said gaps.

11. The workstation of claim 10, further comprising an actuator configured, when operated by a user, to push and/or pull a linkage to rotate the plurality of segments between a collapsed position and a deployed position.

12. The workstation of claim 10, wherein the plurality of sections are made of a sound-absorbing material.

13. The workstation of claim 10, wherein said plurality of segments are interconnected to one another by one or more of a bracket and a pin-and-slot mechanism.

14. The workstation of claim 10, wherein the plurality of sections have a generally arcuate shape that is narrowest at a bottom-most end and widest at a center of the plurality of sections.

15. A workstation, comprising:

an adjustable height desk having a work surface, an acoustical dome privacy shield connected to the work surface and interconnected to said desk and configured to substantially cover at least half of said work surface;

wherein said acoustical dome privacy shield comprises a plurality of sections, each section comprising at least one rectangular or trapezoidal element, wherein the plurality of sections are adapted to be securely and pivotally affixed to one another by a connector;

a linkage system that includes an actuator adapted to rotate the plurality of sections between a collapsed position and a deployed position and wherein the plurality of sections have gaps between them to allow ambient light and/or airflow through said gaps.

* * * * *